United States Patent [19]

Higuchi et al.

[11] 4,097,031

[45] Jun. 27, 1978

[54] LANCE SUPPORTING AND GYRATING DEVICE IN A STEEL-REFINING CONVERTER

[75] Inventors: Kousaku Higuchi, Kakogawa; Satoshi Sato, Kobe; Susumu Wada, Yokohama, all of Japan

[73] Assignees: Kawasaki Jukogyo Kabushiki Kaisha, Kobe; Nippon Kokan Kabushiki Kaisha, both of Japan

[21] Appl. No.: 835,290

[22] Filed: Sep. 21, 1977

[30] Foreign Application Priority Data

| | | |
|---|---|---|
| Sep. 25, 1976 | Japan | 51-114938 |
| Sep. 25, 1976 | Japan | 51-128805[U] |
| Sep. 25, 1976 | Japan | 51-128806[U] |
| Sep. 25, 1976 | Japan | 51-128807[U] |
| Sep. 25, 1976 | Japan | 51-128808[U] |

[51] Int. Cl.[2] ..... C21C 5/32
[52] U.S. Cl. ..... 266/226
[58] Field of Search ..... 266/158, 225, 226

[56] References Cited

FOREIGN PATENT DOCUMENTS 174,388 3/1953 Austria ..... 266/225

*Primary Examiner*—Gerald A. Dost
*Attorney, Agent, or Firm*—Haseltine, Lake & Waters

[57] ABSTRACT

A lance in a converter is supported at a first part thereof on a gimbal mechanism supported on a bridge supported on rotation devices supported on a lance carriage above the converter and operating to drive the bridge and the first part of the lance to undergo a revolutionary motion, and is held at a second part thereof below the first part against horizontal movement by another bearing device, whereby the lance is driven in gyratory motion about the center of the second part as a central node, the radius and speed of gyration of the working end of the lance being adjustable. Pertinent parts of the lance carriage, which can be raised and lowered in guided vertical movement by a hoisting device, are provided with cutout recesses into which the lance in vertical state at the time of installation can be placed by being moved sidewise in horizontal movement, whereby the installation and removal of the lance is greatly facilitated.

12 Claims, 31 Drawing Figures

LANCE SUPPORTING AND GYRATING DEVICE IN A STEEL-REFINING CONVERTER

BACKGROUND

This invention relates generally to converters for producing steels and lances therefor and more particularly to a device for supporting a lance for a converter (hereinafter referred to simply as lance) and causing it to undergo gyratory motion relative to the converter, in which device the attachment and detachment of the lance relative to a lance carriage for supporting the lance is carried out from the side, and the radius of revolution and the speed of revolution of the working end of the lance are adjustable as desired.

In general, if a lance is used in a stationary state in a converter, there will be a great tendency of the slag forming reaction to become non-uniform and partially stagnant in the intermediate stage of refining, whereby the efficiency to remove phosphorus and sulfur in the converter will be unavoidably reduced. As a countermeasure to overcome this difficulty a method of causing the lance to revolve, as disclosed in Japanese Patent Laid Open No. 60415/1975, for example, and as described more fully hereinafter, has been proposed. This method as proposed is accompanied by certain difficulties, as described hereinafter, in the handling of the lance because of its great size and weight in many cases. Furthermore, the radius of revolution of the lance is not adjustable.

SUMMARY

It is an object of this invention to provide a novel lance installing, removing, supporting, and gyrating device (hereinafter referred to as "lance operating device" in some places) in a steel-refining converter in which the above described difficulties are overcome.

A specific object of the invention is to provide a lance operating device in which the radius and the rotational speed of gyratory motion of the working end of the lance can be adjusted.

Another object of the invention is to provide a lance operating device in which, the lance, in a vertical state above and outside of the converter and its exhaust hood, can be attached to or detached from the device by horizontal movement to or away from the device.

According to this invention, briefly summarized, there is provided a device for supporting and gyrating a lance in a steel-refining converter, characterised by: a lance carriage disposed above the converter and supported and adapted to be movable in guided vertical movement; wobble bearing device attached to a part of the lance to support the lance in a manner permitting the same to undergo gyratory motion relative to the bearing device; a lance receiving structure for supporting the wobble bearing device and supported to undergo a revolutionary motion in a horizontal plane about a specific vertical axis; mechanism for supporting the lance receiving structure on the lance carriage in a manner permitting said revolutionary motion; a driving device for driving the lance receiving structure in said revolutionary motion; a lance holding device mounted on the lance carriage at a position vertically apart from the wobble bearing device in its lance supporting state and operated to hold the lance in vertically fixed position coincident with said specific vertical axis; and a node bearing device attachable to the lance at a position such as to fit into a stationary structure disposed below and spaced apart from the wobble bearing device when the lance is in said operative position and functioning to hold the lance against horizontal movement thereof thereby to constitute a central node about which the lance undergoes a gyratory motion when the lance receiving structure is thus driven in said revolutionary motion. Preferably, pertinent parts may be provided with cutout recesses to permit the lance, in vertical position out of and above the converter, to be moved horizontally into position aligned with said specific vertical axis to be supported by the wobble bearing device.

The nature, utility, and further features of this invention will be more fully apparent from the following detailed description with respect to preferred embodiments of the invention when read in conjunction with the accompanying drawings briefly described below, in which like parts are designated by like reference numerals.

DRAWINGS

DETAILED DESCRIPTION

Figure 10:
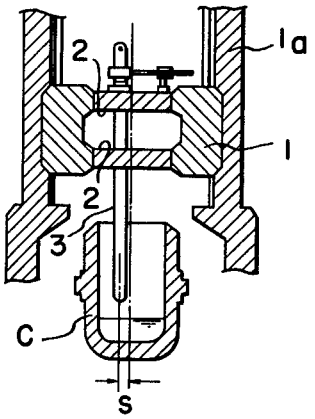
FIG. 10 PRIOR ART
FIG. 10 is an elevation, in vertical section, with a part greatly distorted, showing an example of a known lance operating device.
Figure 12:
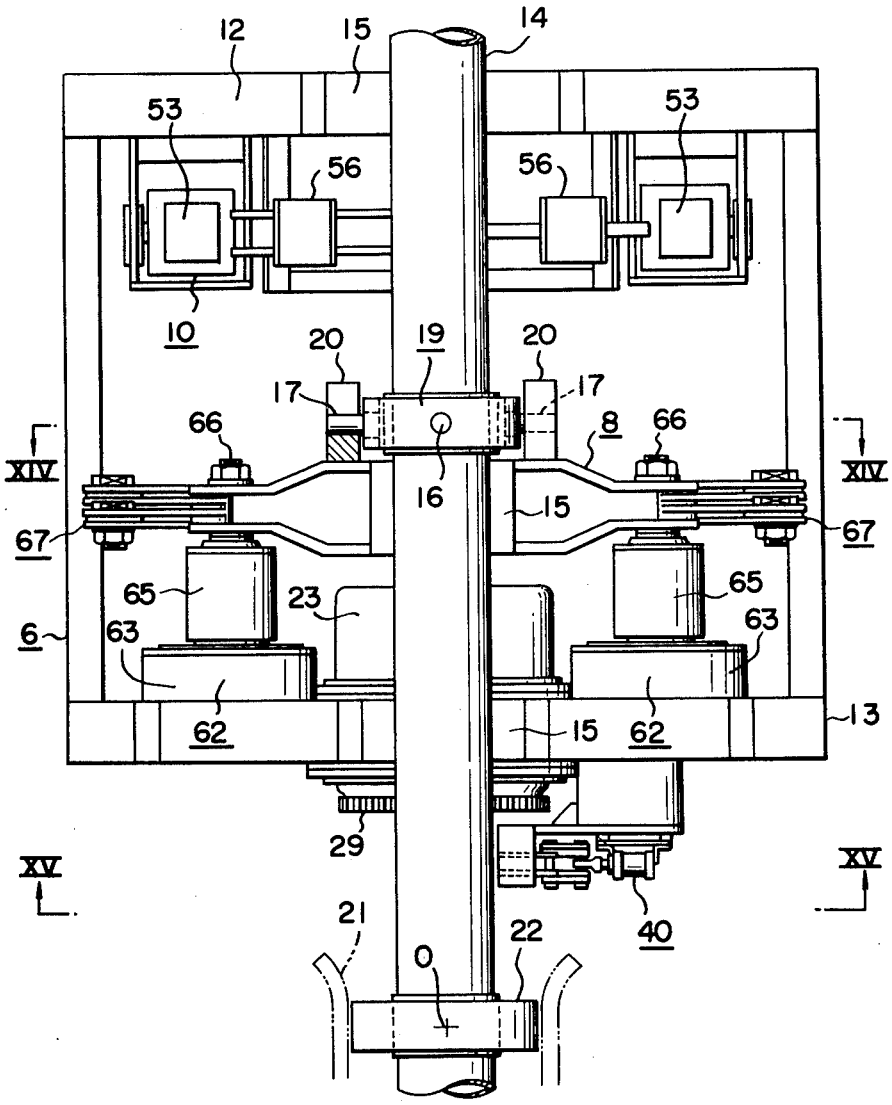
FIG. 12 is a front elevation showing a lance carriage part of the second example of the lance operating device of the invention.

As conducive to a full understanding of this invention, one example of a known method, briefly mentioned hereinbefore, of causing a lance to undergo revolution as in the aforementioned Japanese Patent Laid Open No. 60415/1975 will be briefly considered with reference to FIG. 10.

In this example, a vertical lance 3 for a converter C is supported on horizontal, parallel rotary disks 2, which are rotatably supported at spaced-apart positions on a lance carriage 1 supported in vertically slidable manner by a frame structure 1*a*. The lance 3 is so positioned that its centerline is offset by a distance S from the rotational axis of the rotary disks 2, which are coaxially disposed. Consequently, when the rotary disks 2 are driven in rotation, the lance 3 revolves about the rotational axis of the disks 2 with a radius of rotation of S.

By this arrangement, the insertion and extraction of the lance 3 into and out of the rotary disks 2 as well as the raising and lowering of the lance 3 are carried out by hoisting the lance with means such as a crane. Since the lance 3 in some cases may be as long as 20 meters, with a diameter of 40 cm, and may weigh as much as 10 metric tons, for example, the handling of the lance 3 by a method such as merely suspending with a crane, which tends to be unstable, is difficult and becomes extremely difficult particularly in the work of inserting the lance 3 into the holes in the rotary disks 2. Another problem is that since the lance 3 is provided in an immobile state relative to the rotary disks 2, the radius of revolution of the lance 3 cannot be adjusted.

These difficulties accompanying known lance supporting and revolving devices have been overcome by the present invention, one embodiment of which will now be described.

Figure 1:
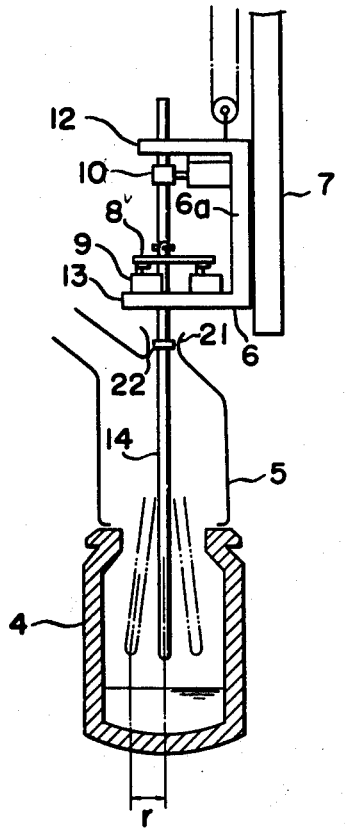
FIG. 1 is a schematic diagram, in side elevation, showing the general construction of a first example of the lance operating device according to this invention and the state of their installation relative to a converter and its hood.

FIG. 1 diagrammatically indicates the general positional relationships between a converter 4 provided with a hood 5 for removing exhaust gases, a lance 14 adapted to be inserted through the hood 5 into the converter 4, a lance supporting and driving device including a lance carriage 6, a lance receiving structure 8, rotation devices 9, a lance holding device 10, and a vertical guide 7 for guiding the lance carriage 6 in vertical movement.

Figure 2:
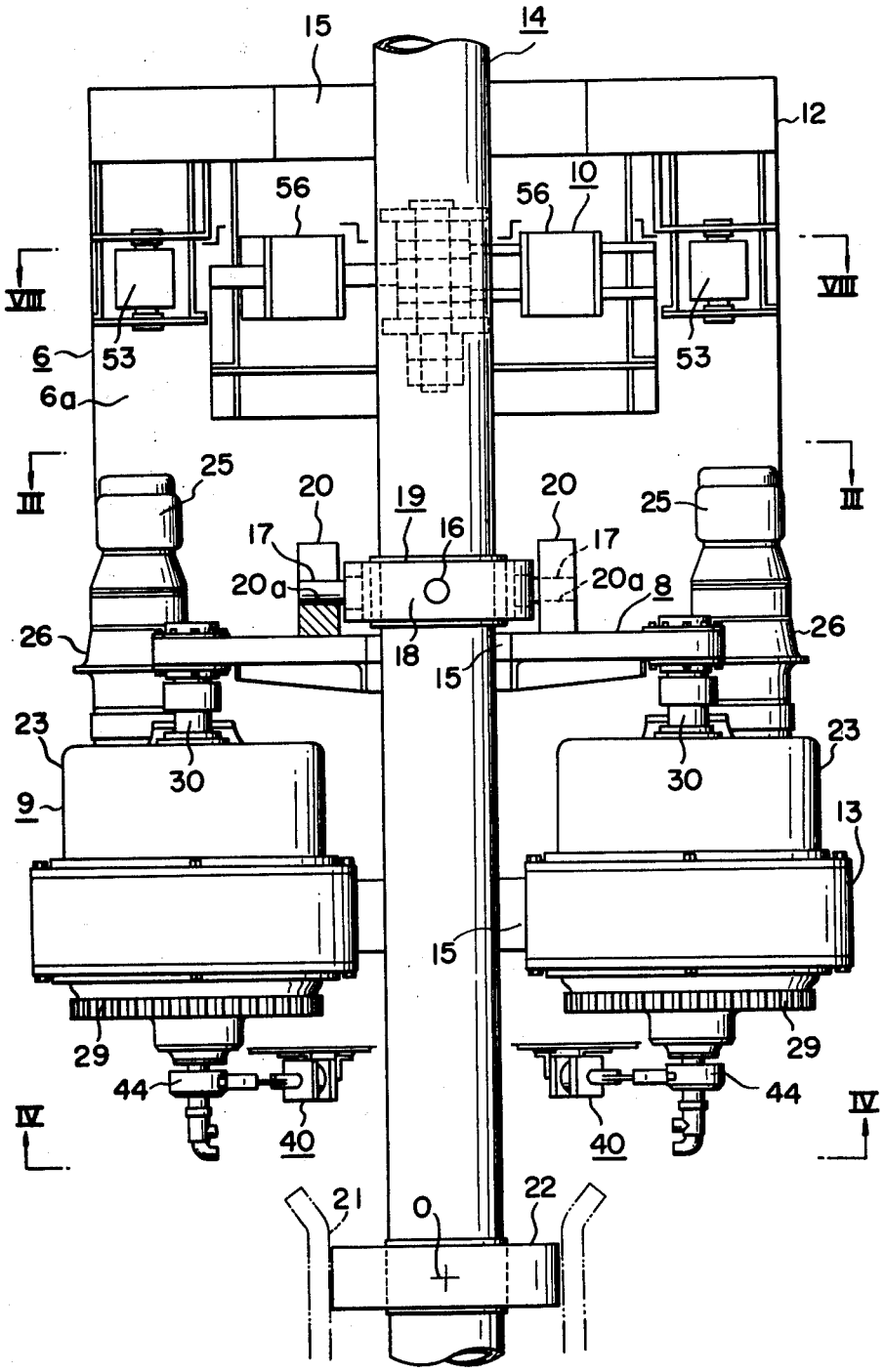
FIG. 2 is a front elevation of a lance carriage part of the first example of the lance operating device of the invention.

The lance carriage 6 has an integral rigid structure comprising a vertical rear part 6*a* and shelf-like upper and lower horizontal platforms 12 and 13 joined to and projecting in the forward direction away from the guide 7 respectively from the upper and lower ends of the vertical part 6*a*. The outer end parts of the horizontal platforms 12 and 13 and the corresponding part of the lance receiving structure 8 are bifurcated, being provided with cutout recesses 15 for permitting the lance 14 to be brought horizontally from the side into its installation position in the lance supporting and driving device, as shown in FIGS. 2, 3, and 4.

The lance 14 is supported in a manner permitting its gyratory movement by a gimbal mechanism 19 constituting a wobble bearing and comprising mutually perpendicular, inner and outer trunnions 16 and 17 and a gymbal ring 18. The outer trunnions 17 are adapted to be journaled in respective saddles 20*a* of bearings 20, which are slotted and thus opened at their upper parts in order to facilitate installation and dismantling of the lance 14. The bearings 20 are mounted on the lance receiving bridge 8. The lance 14 is further provided with a bearing 22 fixed beforehand thereto. The bearing 22 serves to form a node of a gyratory motion as will be described later, and, therefore, will be referred to as "node bearing" hereinafter. This node bearing 22 is adapted to fit into an insertion opening 21 formed in the upper central part of the aforementioned hood 5 upon insertion of the lance 14 through a specific distance into the converter 4 during assembly and functions to assist in causing gyratory or precessional motion of the lance 14 about a central node point O.

As an alternative arrangement, this node bearing 22 can be mounted on the hood 5 at its insertion opening 21 instead of being fixed to the lance 14 as in the instant example.

Figure 3:
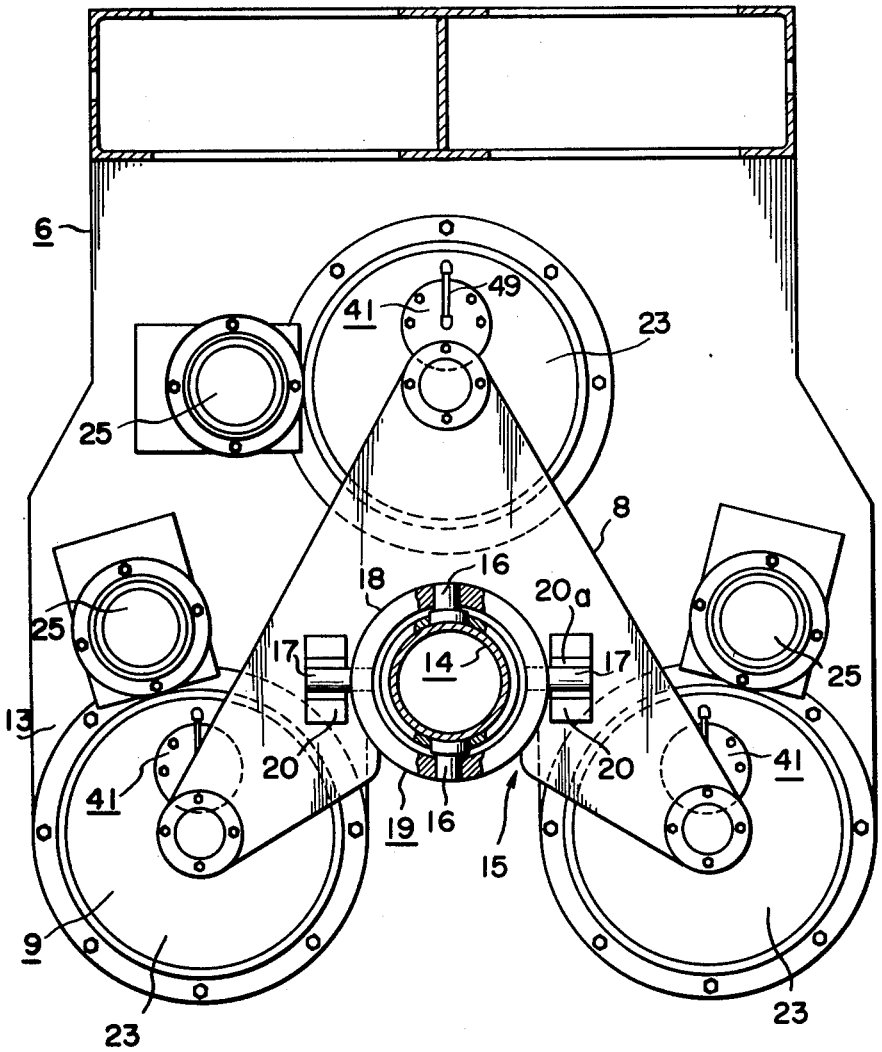
FIG. 3 is a plan view partly in section taken along the plane indicated by line III—III in FIG. 2 as viewed in the arrow direction.
Figure 4:
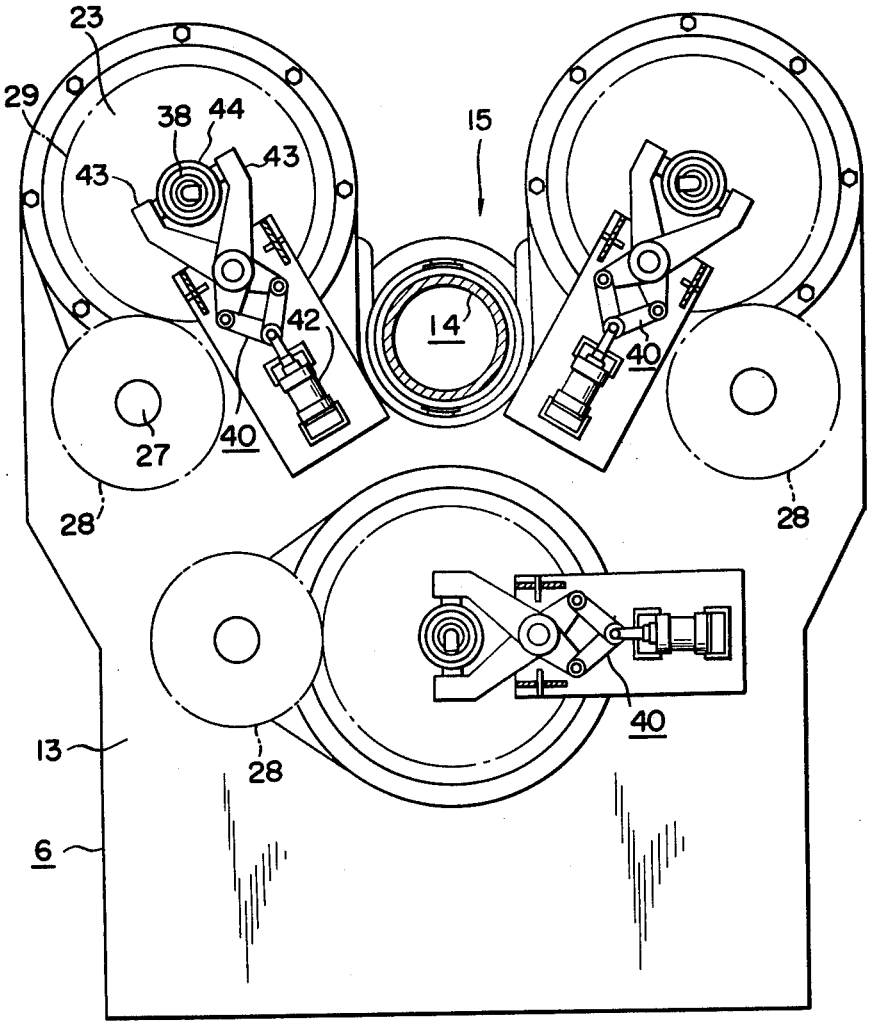
FIG. 4 is a bottom plan view taken along the plane indicated by line IV—IV in FIG. 2 as viewed in the arrow direction.
Figure 5:
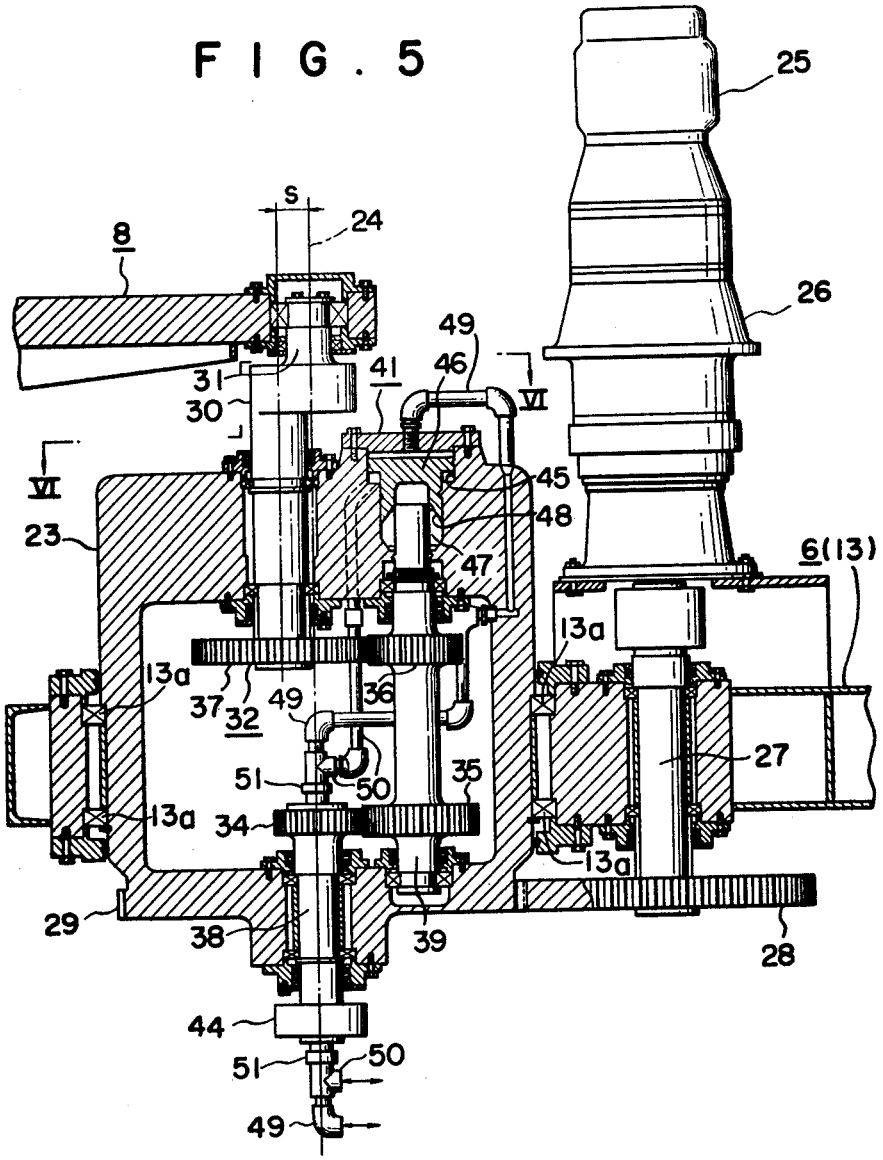
FIG. 5 is an elevation, partly in section taken along a vertical plane passing through the centerlines of principal shafts, showing a rotation device of a lancing receiving bridge of the first example.

The lance receiving bridge 8 has the shape substantially of an equilateral triangle as viewed in plan view except for the above mentioned cutout recess 15 and is supported at the vertices of the triangle on the upper parts of respective support shafts 30 of the aforementioned rotation devices 9, which are supported on the lower platform 13 of the lance carriage 6 as shown in FIGS. 3, 4, and 5. The shape of the lance receiving bridge 8 is not limited to a triangle but may be any suitable equilateral polygon with the cutout recess 15 formed to permit positioning of the lance 14 at the center thereof, the vertices of the polygon being supported on the upper parts of respect vertical support shafts 30 of a corresponding number of the rotation devices 9.

Each of the rotation devices 9 has a rotating base 23 which constitutes a housing and frame for a planetary gear mechanism described hereinafter. This rotating base 23 has a vertical rotational axis 24 (FIG. 5) and is rotatably supported by bearings 13*a* in the lower platform 13 of the lance carriage 6. Each rotating base 23 is driven in rotation by a motor 25 for rotating base driving, which is mounted on the lower platform 13, through a speed changing mechanism 26 and a gear mechanism comprising a gear 28 fixed to an output shaft 27 of the speed changing mechanism 26 and a gear 29 formed integrally with the bottom part of the rotating base 23 and meshed with the gear 28.

Figure 6:
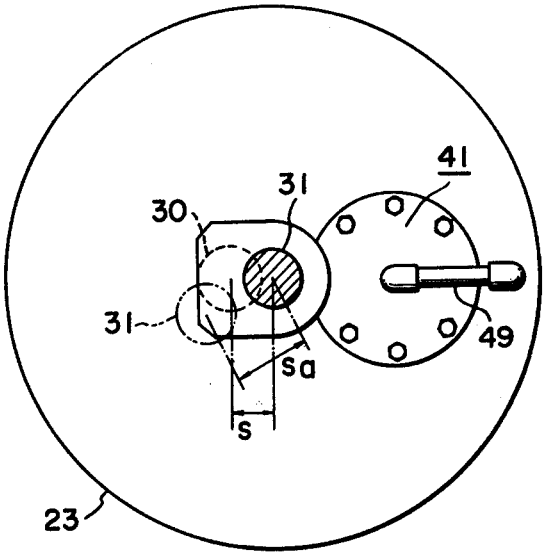
FIG. 6 is a view, partly in section taken along the plane indicated by line VI—VI in FIG. 5, as viewed in the arrow direction.
Figure 7:
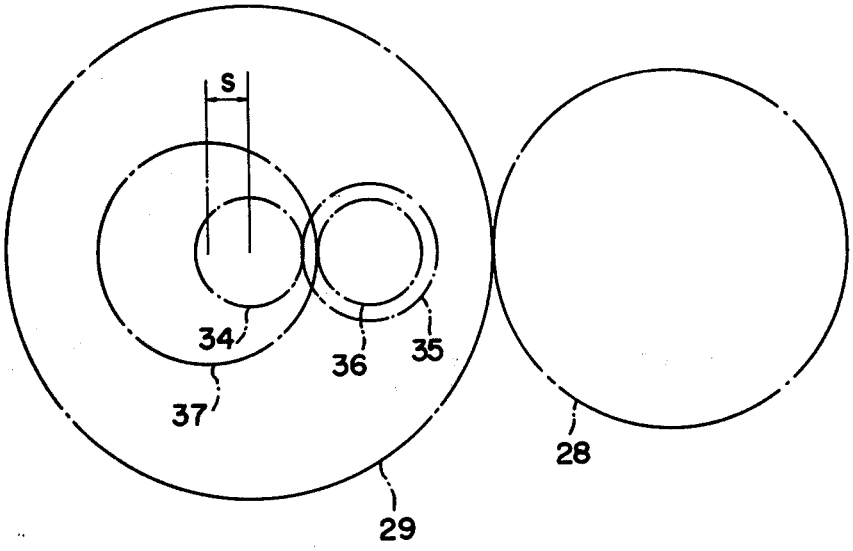
FIG. 7 is a diagrammatic plan view of a gear train.
Figure 8:
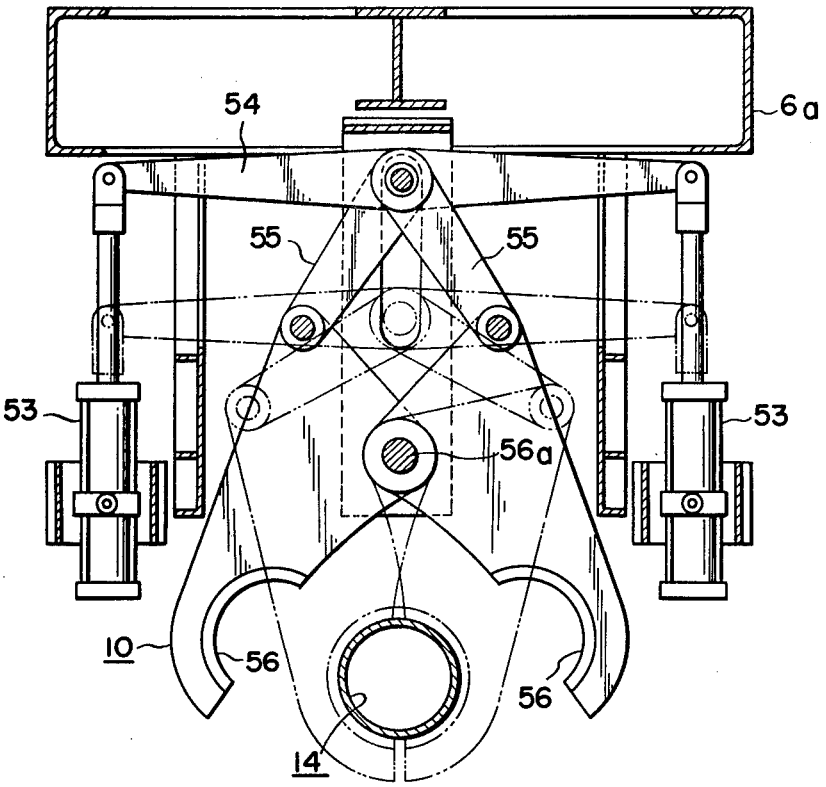
FIG. 8 is a plan view, partly in section taken along the plane indicated by line VIII—VIII in FIG. 2 as viewed in the arrow direction.

Each rotating base 23 rotatably supports at its upper part the above mentioned vertical support shaft 30, the upper end of which extends out of the rotating base 23 and the lower end of which extends into the hollow interior of the rotating base. The support shaft 30 is provided at its upper end with a supporting part 31, which, in concert with the supporting parts 31 of the other support shafts 30, support the lance receiving the bridge 8 horizontally. As shown in FIGS. 5 and 6, the support shaft 30 is eccentrically disposed relative to the rotating base 23, that is, is offset relative to the rotational axis 24 by a distance S, and is rotatably journaled in both the rotating base 23 and the lance receiving bridge 8. The centerline of the supporting part 31 is parallel to but offset from the center line of the support shaft by the same above mentioned distance S, the supporting part 31 thereby constituting a crank part.

An eccentricity adjusting mechanism 32 utilizing a planetary gear device is provided for the support shaft 30. This mechanism 32 has a sun gear 34 fixed to the upper end of a vertical shaft 38, whose centerline is coincident with the rotational axis 24, and which is rotatably supported by the rotating base 23. The sun gear 34 is meshed with a planetary gear 35 fixed to a vertical shaft 39 also rotatably supported by the rotating base 23 and provided with another planetary gear 36 fixed thereto. The planetary gear 36 is meshed with a gear 37 fixed to the aforementioned lower end of the support shaft 30. Upper and lower locking devices 41 and 40 are provided for selectively locking the shaft 39 of the planetary gears 35 and 36 and the shaft 38 of the sun gear 38, respectively.

As shown in FIGS. 2 and 4, each of the lower locking devices 40 is secured to the lower part of the lower platform 13 of the lance carriage 6 and comprises a fluid operated cylinder device 42, a pair of clamp laws 43 operated in opening and closing action by the cylinder device 42 through a toggle mechanism, and a lock drum 44 fixed to the shaft 38 and adapted to be locked by the locking jaws 43. The upper locking device 41 comprises a vertical cylinder 45 formed in the rotating base 23, a piston 46 slidably fitted in the cylinder 45 and having at its lower end an internal tapered surface 48 defining a concave frustoconical recess, and a member 47 fixed to the upper end of the shaft 39 and adapted to be pressed and held by the tapered surface 48 at the time of locking.

The locking device 41 is operated by a working fluid supplied through two pipe lines 49 and 50, which are passed through the shaft 38 and coupled thereto by means of swivel couplings 51.

The aforementioned lance holding device 10 is mounted on the upper part of the lance carriage 6 and has, as its principal part, a pair of clamp jaws 56 adapted to rotate in a horizontal plane to clamp the lance 14 from opposite sides thereof. The principal feature of this lance holding device 10 is that, when these clamp jaws 56 are in their opened states, the lance 14 in vertical state can be moved sideways into position between the clamp jaws to be clamped thereby.

The lamp jaws 56 can be opened and closed by any of several mechanisms. In the instant example, each of these clamp jaws is of a substantially triangular shape in plan view with three corners, a concave semicylindrical surface being formed near of first corner of the triangular jaw on the inner side thereof for attaining surface contact with the cylindrical lance 14. The two clamp jaws 56 are pivoted at their second corners on a common pivot pin 56*a* in a mutually symmetrical state on opposite sides of the pivot pin 56*a*. The third corners of the clamp jaws 56 are pin connected to ends of respective links 55, which are pin connected at their other ends on a common pivot pin fixed to the middle point of a balancing beam lever 54. The two ends of this beam lever 54 are pin connected to the outer ends of the piston rods of respective fluid operated cylinder devices 53. While two cylinder devices 53 are employed in the instant example, the clamp actuating mechanism need not be thus limited, it being possible to use a mechanism actuated by a single cylinder device.

The operation of the lance operating device of the above described construction according to this invention will now be described. The clamp jaws 43 of the locking devices 40 are closed thereby to lock the lock drums 44, that is, the shaft 38 of the sun gear 34. Conversely, fluid pressure is supplied through the pipe line 50 for the locking device 41 thereby to raise the piston 46, that is, to release the shaft 39 of the planetary gears 35 and 36 from its locked state. With the shafts 38 and 39 in these states, the motors 25 of the rotation devices 9 are started thereby to rotate the rotating bases 23 in synchronism.

As a consequence of the rotation of the rotating bases 23, the planetary gears 35 revolve around their respective sun gears 34, and, at the same time, each gear 37 fixed to the support shaft 30 and meshed with the other planetary gear 36 rotates relative to the rotating base 23. As a consequence, the eccentricity Sa of the supporting part 31 of each support shaft 30 relative to the rotating base 23 varies as indicated by chain line in FIG. 6. This variation makes possible the adjustment of the radius *r* of revolution (as shown in FIG. 1) of the lance 14 as will be apparent from the description set forth hereinafter. It will be obvious that, since all rotating bases 23 can rotate, all support shafts 30 are set to be of the same rotational phase relative to each other. Furthermore, by providing a variable speed mechanism for each motor 25 or each speed changing mechanism 26, adjustment of the revolving speed of the lance 14 becomes possible.

At the time of adjustment of the above mentioned eccentricity Sa, the rotation of the corresponding support shaft 30 has the effect of causing the lance receiving bridge 8 to undergo eccentric rotation. Then, when all eccentricities Sa are caused to be zero, that is, when the supporting parts 31 of the support shafts 30 are placed in a coaxial state with the respective rotating bases 23 as indicated by solid line in FIG. 6, the lance receiving bridge 8 assumes a positional relationship wherein its lance supporting center coincides with the vertical centerline of the converter 4.

Then, with the device in this state, with the lance carriage 6 in raised state, and, moreover, the clamp jaws 56 of lance holding device 10 in opened state, the lance 14 is hoisted vertically by hoisting means (not shown) such as a crane and, at the same time, is moved sideways and directly placed into the cutout recesses 15 of the lance carriage 6 and the lance receiving bridge 8. Thereafter, by lowering the lance 14, the outer trunnions 17 of the gimbal mechanism 19 secured to the lance 14 are fitted into the bearing slots 20*a* of the bearings 20 on the lance receiving bridge 8 and thus fitted into the saddles of the bearings 20.

Next, the clamp jaws 56 of the lance holding device 10 are closed to fix the lance 14 vertically. The above mentioned hoisting means is then disconnected from the lance 14 and removed, and the lance carriage 6 is lowered together with the lance to insert the lower working end of the lance through the insertion opening 21 of the hood 5 to a specific point of the interior of the converter 4, whereupon the node bearing 22 secured to the lance 14 fits into the opening 21.

Then, with the clamp jaws 56 of the lance holding device 10 in opened state, the motors 25 of the rotation devices 9 are again operated in synchronism, and the eccentricity Sa of each support shaft 30 relative to rotating base 23 is adjusted. When this eccentricity Sa becomes a specific value, the clamp jaws 43 of each lower locking device 40 for the sun gear shaft 38 are opened, and, conversely, each upper locking device 41 is placed in its locking state, that is, fluid pressure is supplied to the pipe line 49 to push the piston 46 downward and thereby to apply a tightening and braking force due to the wedge effect of the tapered surface 48 on the shaft 39 of the planetary gears 35 and 36, whereby each support shaft 30 is locked to its rotating base 23. As a result, the lance receiving bridge 8 revolves eccentrically in cranking motion with the eccentricity Sa as its rotational radius. As a consequence of this rotation, the lance 14 is caused to undergo a gyratory motion with the node bearing 22 as a central node.

It is to be noted that it is also possible to provide a locking device similar to device 41 for the support shaft 30 or the shaft 38 of the sun gear 34.

Furthermore, while one motor 25 is provided for each of the rotating bases 23 in the above described example, one motor may be used in the case where merely driving the rotating bases 23 is the object. Of course, even in the case where only one motor 25 is used, it is possible to drive all rotating bases 23 interrelately thereby to adjust simultaneously their respective eccentricities Sa.

Figure 9:
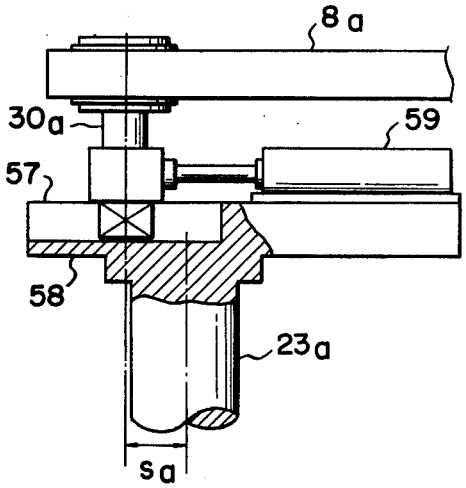
FIG. 9 is an elevational, with a part cut away, showing an example of modification of a mechanism for adjusting eccentricity.

In addition, for the means for adjusting these eccentricities, a mechanism such as the modified example shown in FIG. 9 can also be used. In this mechanism, a base 58 for slidable engagement with the lower end of a support shaft 30*a* and for enabling the same to slide along a groove 57 in the radial direction of a solid rotating base 23*a* is formed at the upper part of each rotating base 23*a*. The support shaft 30*a* supports at its upper end a part of a lance receiving bridge 8*a* and is caused to undergo sliding movement along the base 58 by an actuator 59 such as a fluid operated cylinder, whereby the eccentricity Sa can be adjusted.

Since the lance operating device according to this invention has a construction as described above in which the lance can be moved sideways into the lance carriage for installation therein, the work of replacing or exchanging the lance is greatly facilitated in comparison with that wherein the lance must be raised and lowered through a great distance as in the prior art example illustrated in FIG. 10. Furthermore, since the radius of revolution as well as the revolving speed of the lance can be adjusted, the most effective refining operation can be carried out with a radius of revolution conforming appropriately to the conditions of the converter. By setting the radius of revolution at zero, of course, the lance can also be used in a stationary state as in some converters of the prior art.

Still another advantageous feature of the device of this invention is that the lance height can be adjusted as desired, whereby the choice between soft blow and hard blow, which are important metallurgical factors can be selected independently of the eccentricity of the hot spot.

A second embodiment of this invention will now be described with reference to FIGS. 11 through 17. In the following description of this second embodiment and of subsequent embodiments of this invention, those parts which are the same as or functionally the equivalent of corresponding parts in the first embodiment of the invention illustrated in FIGS. 1 through 9 are designated by like reference numerals but will not be described again in detail.

Figure 11:
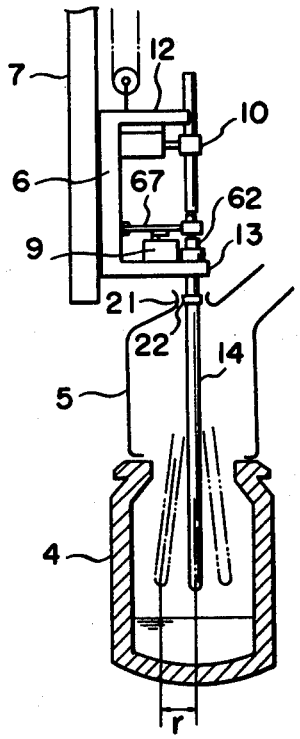
FIG. 11 is a schematic diagram similar to FIG. 1, but showing the general construction of a second example of the lance operating device according to this invention.

The general structural arrangement of this second example, as shown in FIG. 11, is similar to that of the preceding example. This second example differs from the first example principally in the construction of the lance receiving bridge 8, its supporting mechanism, and associated parts.

Figure 16:
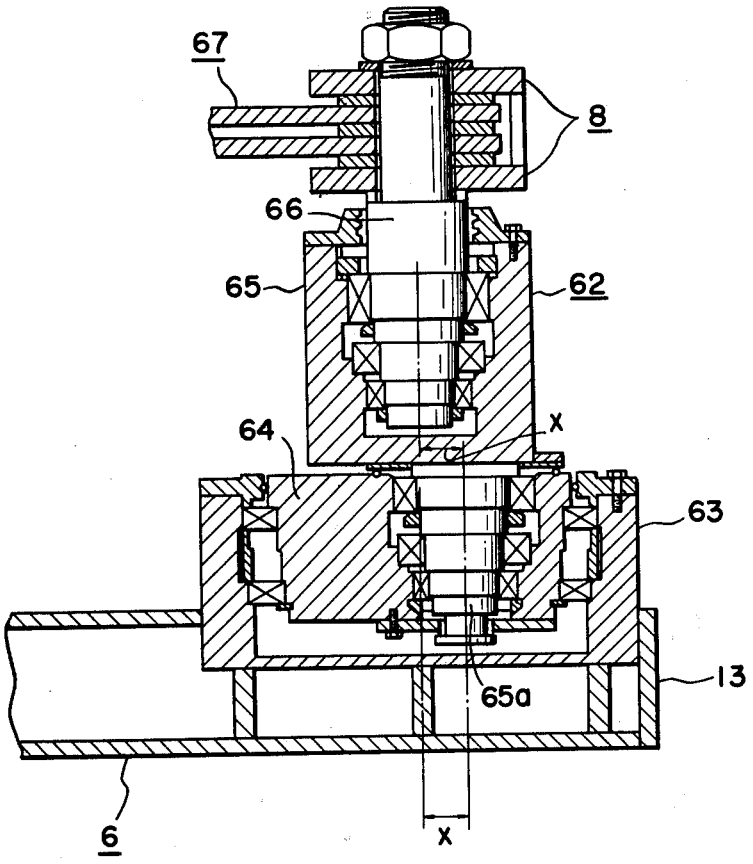
FIG. 16 is an elevation, partly in vertical section taken along a plane passing through the centerlines of principal shafts, showing a rotating support and related parts of the second example.
Figure 17:
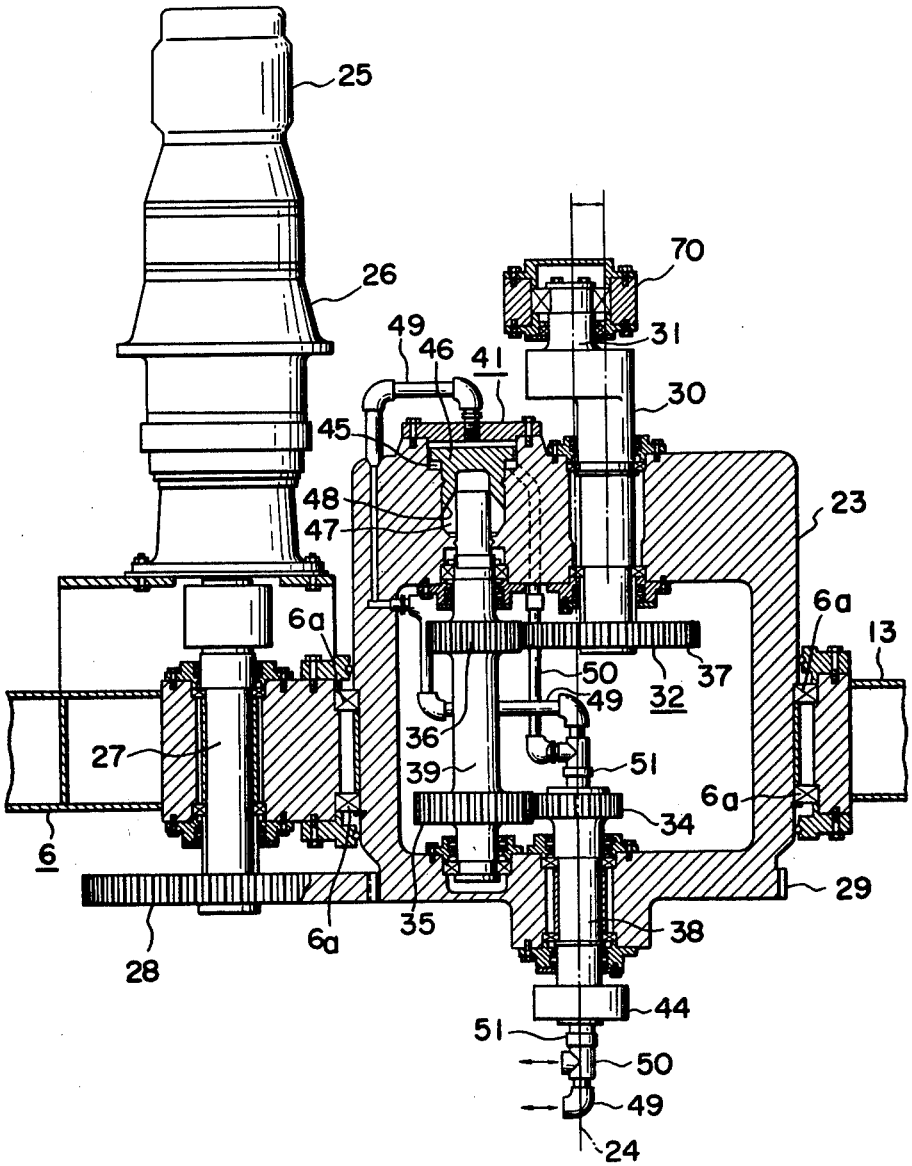
FIG. 17 is an elevation, partly in section, taken along a vertical plane passing through the centerlines of principal shafts, showing a rotation device of a lance receiving bridge of the second example.
Figure 18:
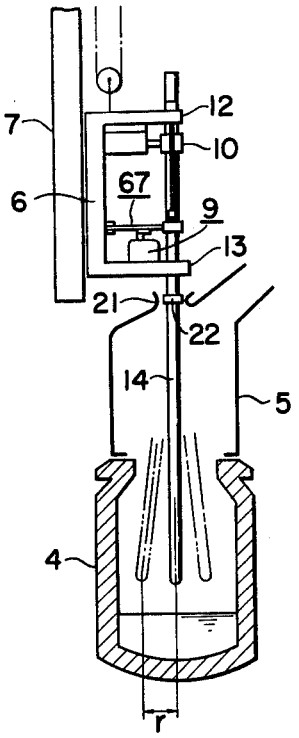
FIG. 18 is a schematic diagram similar to FIG. 1, but showing the general construction of a third example of the lance operating device according to this invention.

The lance receiving bridge 8, which has the shape of a yoke with two ends and a central cutout recess 15 and is provided with bearings 20 for supporting a gimbal mechanism 19 similar to that in the first example, and is supported at its ends by a pair of rotating supports 62. As shown in FIG. 16, each rotating support 62 comprises a bearing 63 fixedly mounted on the lower platform 13 of the lance carriage 6, a rotating base 64 rotatably supported by the bearing 63 and a rotating pedestal 65 having at its lower end a vertical eccentric shaft 65*a* which is rotatably supported by the rotating base 64. The rotating pedestal 65 rotatably supports the lower end of a vertical shaft 66 fixed at its upper end to one end of the lance receiving bridge 8. The rotating base 64, the rotating pedestal 65, and the shaft 66 have a mutual eccentricity of $x$ and are supported in a manner permitting their relative rotations according to the revolutionary motion of the lance receiving bridge 8.

The lance receiving bridge 8 is further provided with a pair of parallel-bar expandable linkages 67 forming a parallel-motion mechanism. Each linkage 67 is of the pantograph type or the so-called "lazy tongs" type and, at one end thereof in the expandable direction, is pin connected by a pin 68 to a bearing 69 fixedly mounted to a rear part of the lance carriage 6. At its other front end, each linkage 67 is rotatably connected to the upper end of the above mentioned shaft 66 fixed to one end of the lance receiving bridge 8.

Figure 13:
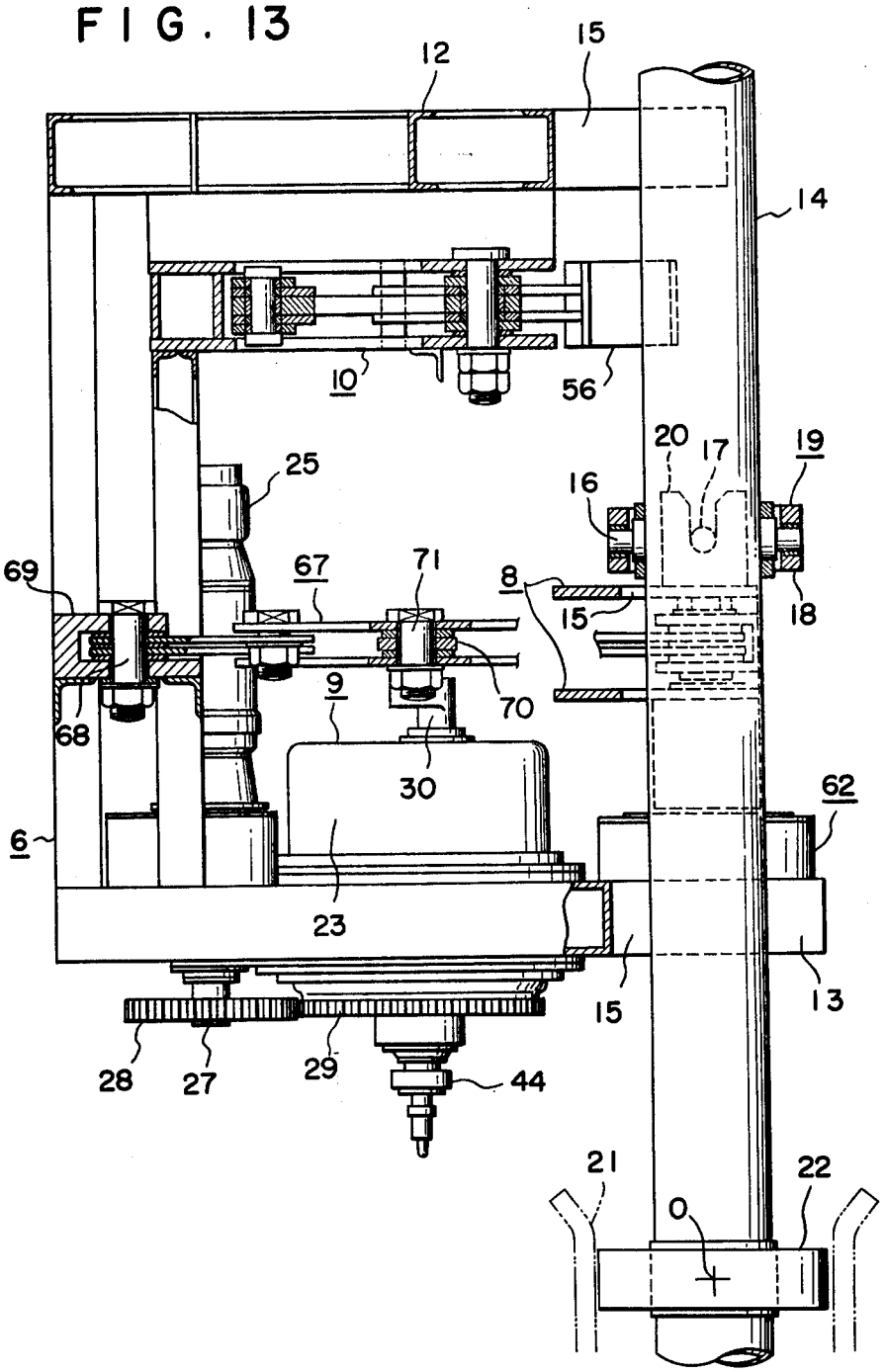
FIG. 13 is a side elevation orthogonal to the view of FIG. 12, with parts cut away.
Figure 14:
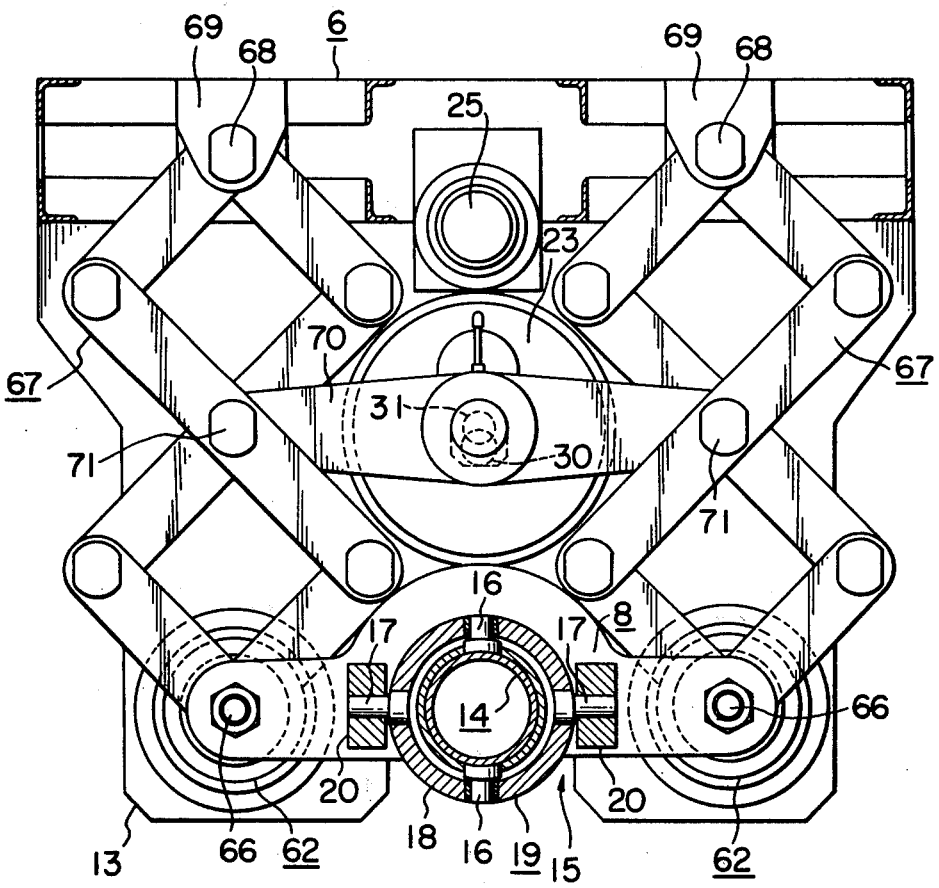
FIG. 14 is a plan view, with a part in horizontal section, taken along the plane indicated by line XIV—XIV in FIG. 12 as viewed in the arrow direction.
Figure 15:
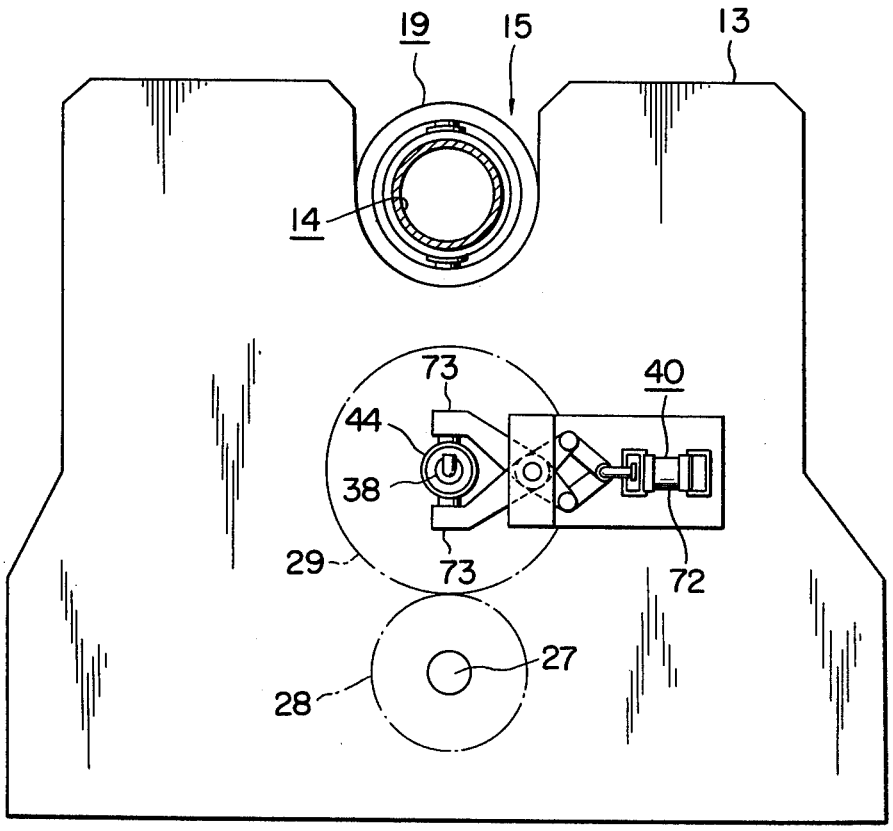
FIG. 15 is a bottom plan view taken along the plane represented by line XV—XV in FIG. 12 as viewed in the arrow direction.

In the instant second example, only one rotation device 9 is provided. This rotation device 9, which is of the same construction as each of the three rotation devices 9 in the first example, is also mounted on the lower platform 13 of the lance carriage 6 at a position between the two expandable linkages 67 and between the bridge 8 and the rear vertical part of the lance carriage 6. The supporting part 31 of the eccentric support shaft 30 is rotatably connected to the middle part of a movement transmitting link 70. This link 70 is parallelly disposed relative to the lance receiving bridge 8 as shown in FIGS. 13 and 14 and is pin connected at its two ends by pins 71 to center pin joints of the two expandable linkages 67.

The lower locking device 40 (FIGS. 12 and 15) is provided on the lower platform 13 of the lance carriage 6 at a position therebelow and has a fluid operated cylinder device 72 and clamp jaws 73 actuated by the cylinder device 72 to clamp and lock the lock drum 44.

In other respects, the construction of the device of this second example is similar to that of the device of the first example.

At the time of adjustment of the eccentricity S*a* (FIG. 6), the movement transmission link 70 is moved by the rotation of the eccentric support shaft 30, but since the expandable linkages 67 are coupled by the link 70 and the pins 71, they operate to move the lance receiving bridge 8 in a multiple manner while retaining their expanding and folding action as well as their parallel motions.

At the time of gyratory motion of the lance 14 with the node bearing 22 as a node as described hereinbefore with respect to the first example, the rotating bases 64 and the rotating pedestals 65 of the rotating supports 62 undergo relative rotation between the bearings 63 and the shafts 66 in accordance with the revolution of the lance receiving bridge 8, thus enabling the bridge 8 to rotate smoothly. Other features of the operation of the instant example are the same as or similar to those of the first example.

Instead of the expandable linkage 67 of pantograph type, a mechanism comprising simply rod members fitted to freely extend and contract can be used.

As described above since only one driving means, i.e., only one rotation device 9, is used in the lance supporting and rotating device of this second example, great economy is achieved. Furthermore, the lance receiving bridge 8 is supported on rotating supports 62 conforming to the revolution of the bridge 8 and thereby operates smoothly. Moreover, since the bridge 8 is thus supported from below, the support is safer than that in the case of suspension.

In a third embodiment of this invention as illustrated in FIGS. 18 through 21, the lance receiving bridge 8, which is similar to that in the preceeding second example, is supported at its ends in a suspended state by a pair of suspension devices 74 secured to the upper platform 12 of the lance carriage 6. Each suspension device 74 has a suspending rod 75 provided at its upper end with a retaining collar 75*a* fixed thereto and resting on a washer 76 with a spherical lower surface, which is seated on a spherical bearing seat 77 fixedly mounted on the upper platform 12. Thus, the suspending rod 75 is free to swing within a limited angular range. The lower end of each suspending rod 75 is connected by way of a universal joint 79, having mutually perpendicular pins 80 and 81, to a supporting member 78 of the lance receiving bridge 8.

At the time of the gyratory motion of the lance 14, the suspending rods 75 of the suspension devices 74 swing pivotally about their upper ends, and the universal joints 79 at the lower parts of the suspending rods 75 rock about the pins 80 and 81, whereby the lance receiving bridge 8 is caused to rotate smoothly.

In all other aspects of construction and operation, the instant third example is similar to the preceding second example. A feature of this third example is that, since the lance receiving bridge 8 revolves smoothly in a state of suspension by the suspension devices 74 which move in accordance with the revolutionary motion of the bridge 8, the required driving power is reduced.

In a fourth embodiment of this invention as shown in FIGS. 22 through 27, the rotation device 9 of the lance receiving bridge 8 has a plurality of (i.e., three in the illustrated example) vertical rotating base shafts 82 rotatably mounted on the lower platform 13 of the lance carriage 6 at respective positions which are equidistant from the lance position and are spaced at equal anqular intervals from each other thereby forming an equilateral polygon. Each rotating base shaft 82 is rotatably supported by bearings 83 mounted on the lower platform 13.

Figure 25:
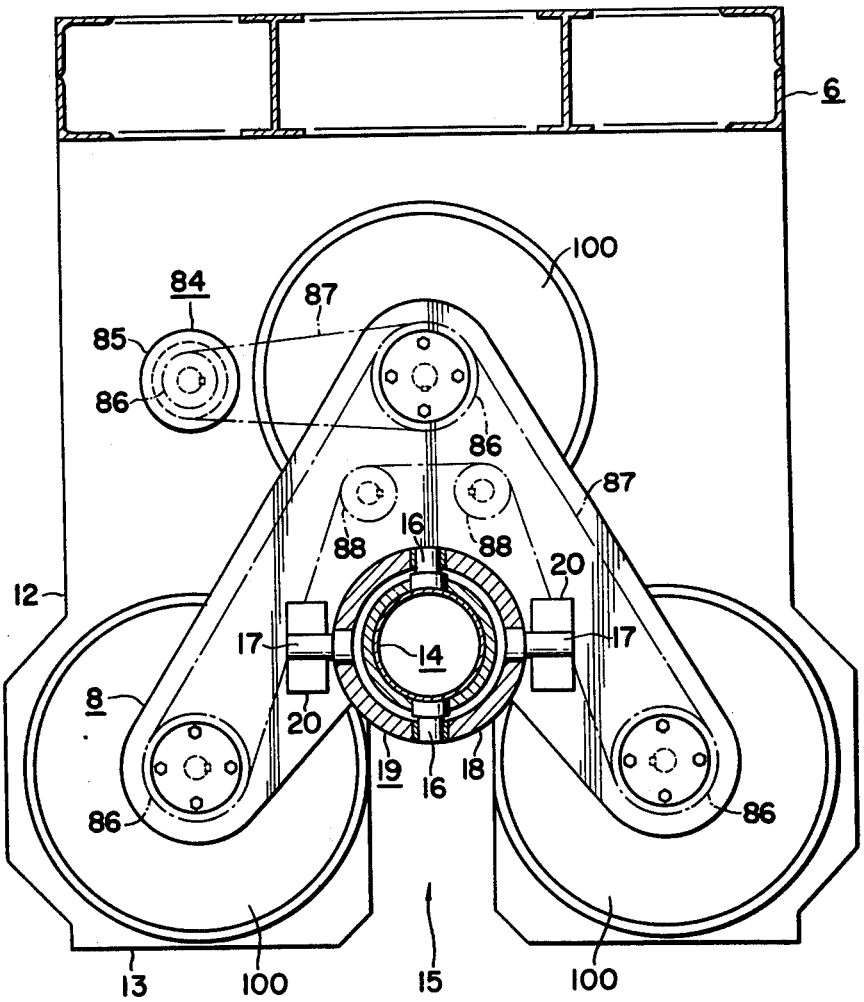
FIG. 25 is a plan view, with a part in horizontal section, taken along the plane indicated by line XXV—XXV in FIG. 23 as viewed in the arrow direction.
Figure 26:
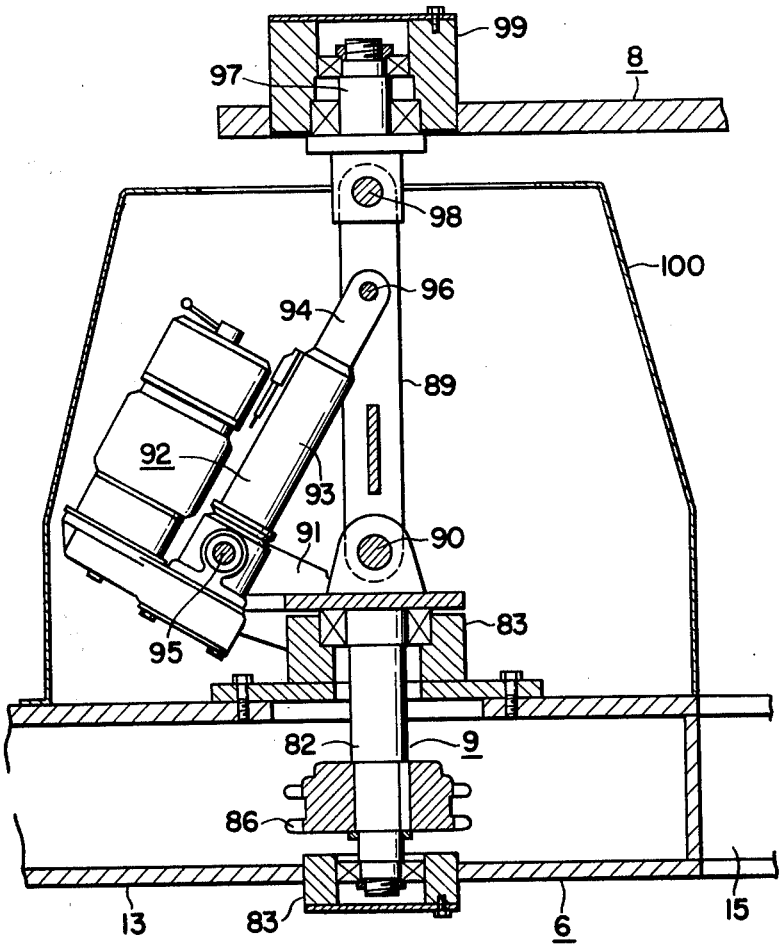
FIG. 26 is a relatively enlarged side elevation, with parts shown in vertical section, showing the essential construction of one of the three rotation devices for supporting and gyrating a lance receiving bridge in the fourth example, the device being set for zero eccentricity.

All three rotating base shafts 82 are provided with respective sprocket wheels 86 fixed to their lower ends and are mutually intercoupled by an endless chain 87 passed around these three sprocket wheels 86 and around two idler wheels 88. As shown in FIG. 25, one of the rotating base shafts 82 is provided with a second sprocket wheel fixed thereto and intercoupled by another endless chain 87*a* to a driving sprocket 86*a* fixed to the output shaft of a driving device 84 comprising a motor 85 and a speed-changing mechanism (not shown). Thus, rotational motive power from the motor 85 is transmitted through the speed-changing mechanism, the driving sprocket 86*a*, the endless chain 87*a*, the sprocket wheel 86 driven thereby, and hence to the other sprocket wheels 86 thereby to drive all rotating base shafts 82 in synchronism.

The upper end of each rotating base shaft 82 is pin connected by a pin 90 to the lower end of a connecting link or rod 89, which can thereby undergo tilting movement about the pin 90 in a plane perpendicular to the pin 90. The angle of tilt of the connecting rod 89 is adjusted by an actuator 92 having a fluid operated cylinder 93 and a piston stem 94. The lower end of the cylinder 93 is pin connected by a pin 95 to a bracket 91 fixed to the upper end of rotating base shaft 82, while the upper or outer end of the piston stem 94 is pin connected by a pin 96 to an intermediate part of the connecting rod 89.

The upper end of each connecting rod 89 is pin connected by a pin 98 to the lower end of a support shaft 97, the pin connection permitting the above mentioned tilting movement of the connecting rod 89. The upper end of the support shaft 97 is rotatably connected by a bearing 99 to one corner of the lance receiving bridge 8. Thus, the above described rotation device 9 operates in cooperation with the other two rotation devices 9 to drive the lance receiving bridge 8 in revolution while supporting the same horizontally. The upper part of the rotating base shaft 82, the lower bearing 83, the connecting rod 89, the bracket 91, and the actuator 92 of each rotation device 9 are enclosed by a cover 100.

In the operation of the device of the instant fourth example, the piston stem 94 of each actuator 92 is first extended to bring the corresponding connecting rod 89 into its vertical position and thereby to reduce to zero the eccentricity of the support shaft 97 relative to the rotating base shaft 82. As a result, the lance receiving bridge 8 is placed in a state wherein its lance supporting center is coaxial with the converter 4.

The lace 14 is then placed in operative position by means of the lance holding device 10 and hoisting means such as a crane as described hereinbefore.

Figure 22:
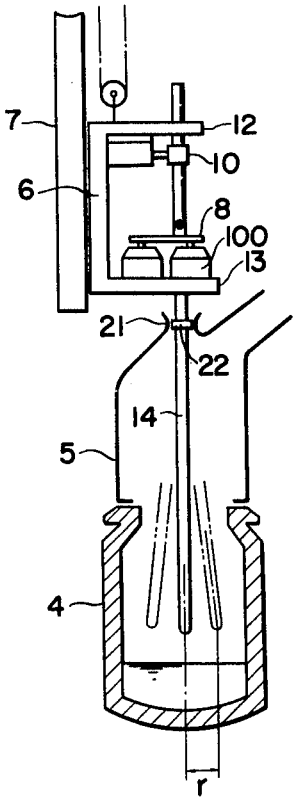
FIG. 22 is a schematic diagram similar to FIG. 1, but showing the general construction of a fourth example of the lance operating device according to this invention.
Figure 19:
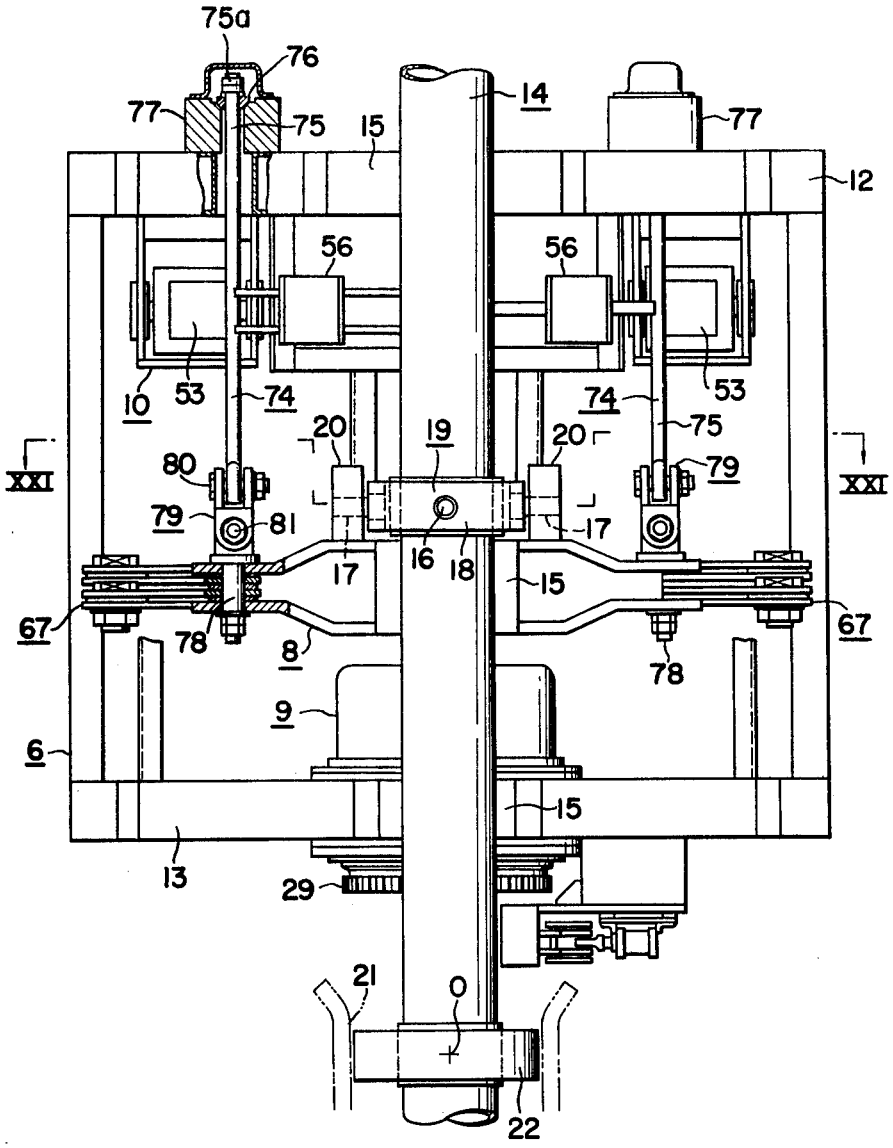
FIG. 19 is a front elevation of a lance carriage part of the third example of the lance operating device of the invention.
Figure 20:
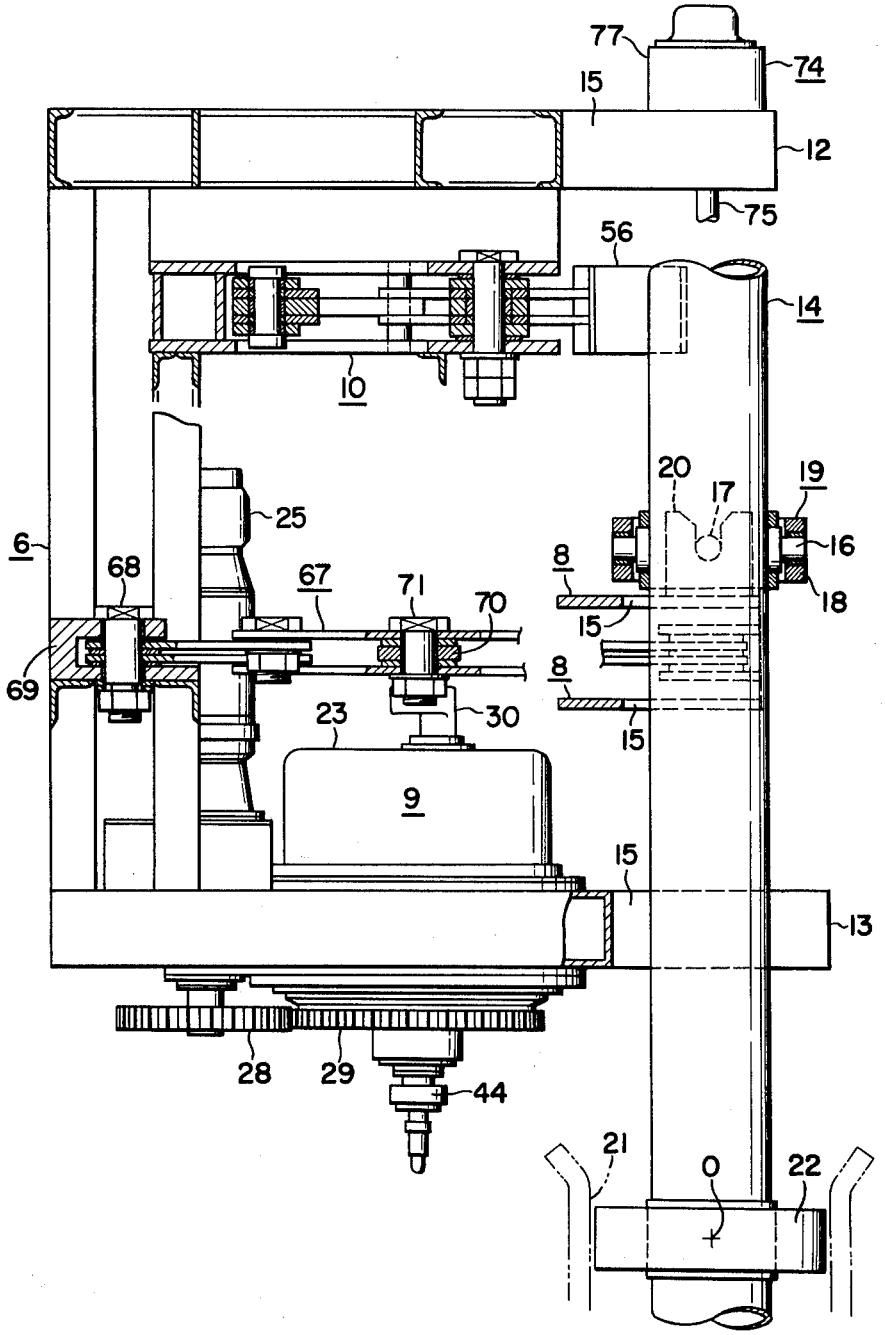
FIG. 20 is a side elevation orthogonal to the view of FIG. 19, with parts cut away.
Figure 21:
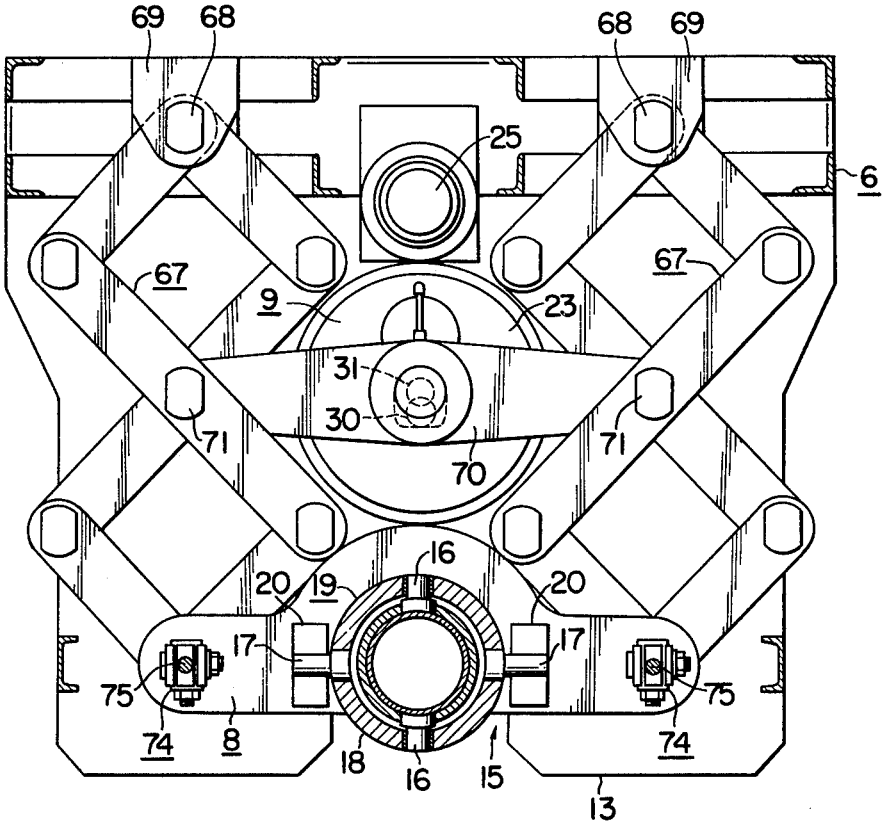
FIG. 21 is a plan view, partly in section, taken along the plane indicated by line XXI—XXI in FIG. 19 as viewed in the arrow direction.
Figure 23:
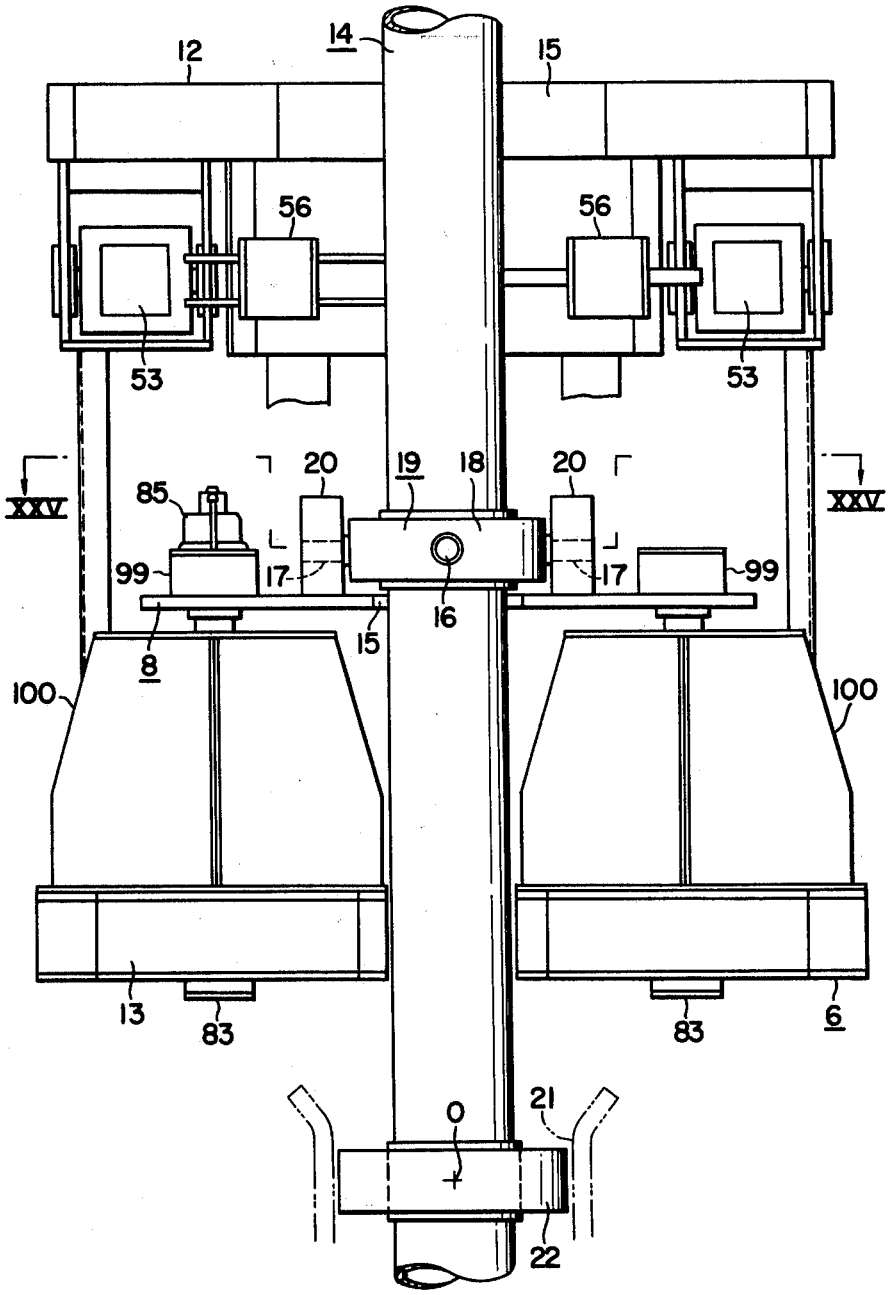
FIG. 23 is a front elevation of a lance carriage part of the fourth example of the lance operating device of the invention.
Figure 24:
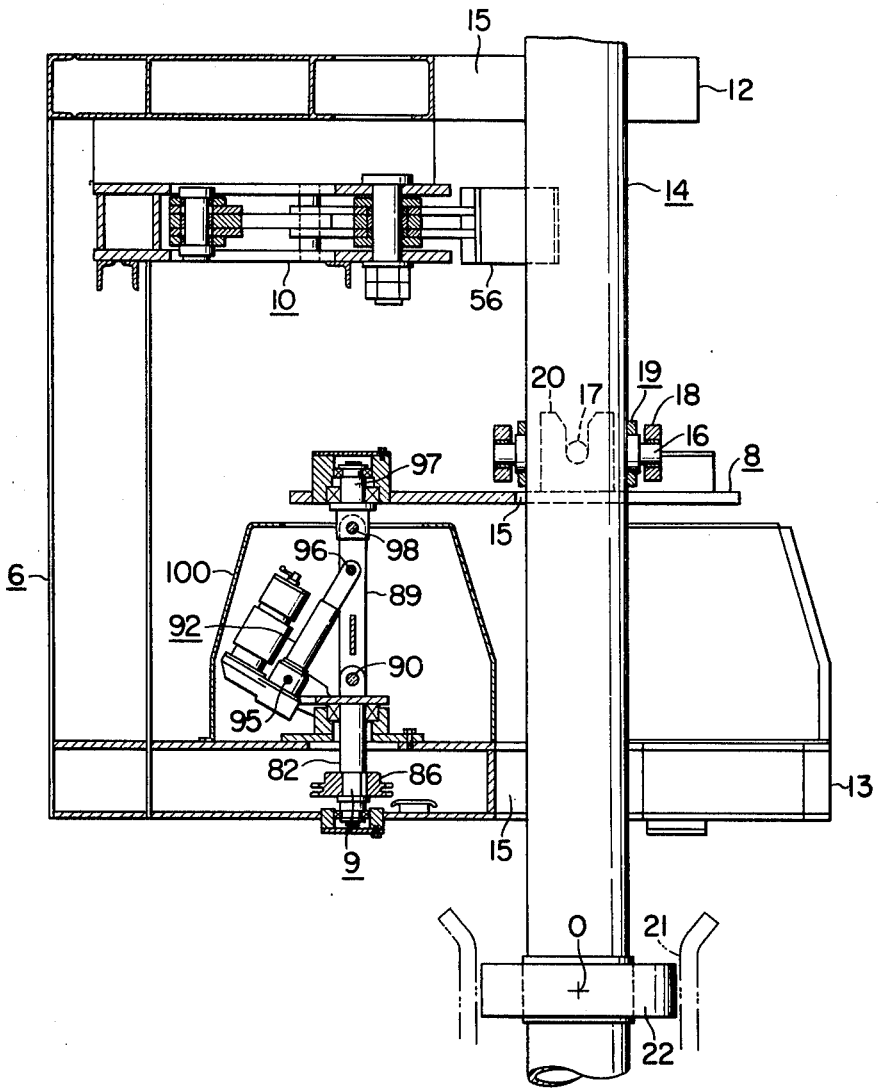
FIG. 24 is a side elevation orthogonal to the view of FIG. 23 with some parts shown in vertical section.
Figure 27:
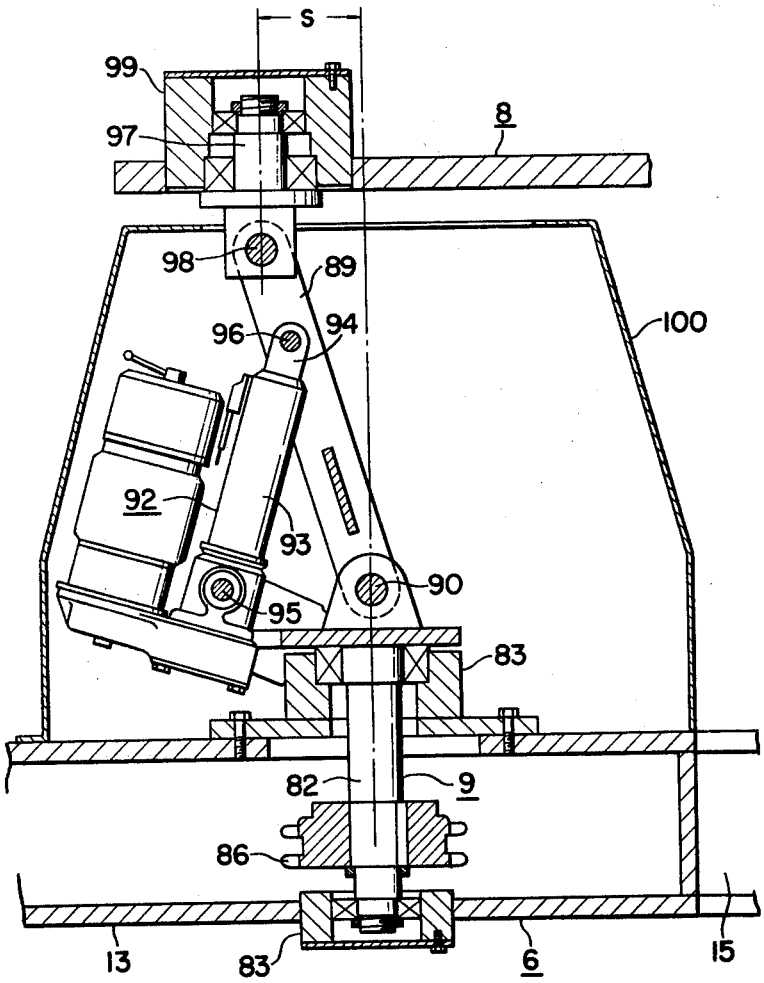
FIG. 27 is a view similar to FIG. 26 showing the device set with a certain eccentricity.

Then, after the lance 14 has been fitted through the node bearing 22 into the insertion opening 21 of the exhaust hood 5 of the converter 4, the clamp jaws 56 of the lance holding device 10 are opened, and the piston stems 94 of the actuators 92 are retracted through a specific distance. As a consequence, all three connecting rods 89 tilting in the same direction about their pins 90, and all support shafts 97 become offset in the same direction by a specific eccentricity relative to their respective rotating base shafts 82 as shown in FIG. 27. After the eccentricities of the support shafts 97 relative to the rotating base shafts 82 have been set at the value S, the motor 85 is started to drive the rotating base shafts 82 in synchronized rotation. As a result, the lance receiving bridge 8 undergoes an eccentric revolution with the specific eccentricity S as the radius of revolution. This revolution of the bridge 8 causes the lance 14 to gyrate with the wobble bearing 22 as a central node. Accordingly, the radius *r* of revolution of the lower end of the lance 14 (as shown in FIG. 22) can be adjusted as desired by adjustably varying the angle of tilt of the connecting rods 89, that is, the eccentricity S of the support shafts 97 relative to the rotating base shaft 82.

Other features of construction and operation of the fourth embodiment of this invention are the same or similar to those of the preceding embodiments of the invention.

In still another embodiment of this invention as illustrated in FIGS. 28 through 31, the saddle bearings 20 for journalling the trunnions 17 of the gimbal mechanism 19 secured to the lance 14 are fixedly mounted on a fore-and-aft truck 109 adapted to move in the fore-and-aft direction (i.e., horizontally away and toward the guide 7 and the upright rear part 6*a* of the lance carriage 6). The fore-and-aft truck 109 is thus movably supported on a transverse truck 108 adapted to move in the transverse direction (i.e., horizontally and parallelly to the rear part 6*a* of the lance carriage 6). The transverse truck 108 is thus movably supported on the lower platform 13 of the lance carriage 6. The manner in which the trucks 109 and 108 are thus movably supported is described more fully below.

A pair of rail supporting members 124 of channel cross section are fixedly laid parallelly in spaced apart positions and in the transverse direction on the lower platform 13. These channel-shaped members 124 rest on one of their flanges with their respective concavities facing each other. Rails 114 for travel of the transverse truck 108 are fixedly supported on the inner sides of the lower flanges of these rail supporting members 124, and rails 122 for preventing upward lifting of the transverse truck 108 are fixedly supported on the inner sides of the upper flanges of these members 124. The rails 122 are disposed directly above and in parallel with the respective rails 114.

The chassis of the transverse truck 108 is provided at its front and rear sides with wheels 116 which roll on their respective rails 114 and are prevented from jumping up and off the rails 114 by the upper rails 122. The chassis of the transverse truck 108 is further provided at its front and rear sides with rollers 120 which roll along guide rails 118 fixed to the inner sides of the webs of the channel-shaped rail supporting members 124 and functioning to prevent side movement of the transverse truck 108. The transverse truck 108 is driven in travel in the transverse direction by a fluid operated cylinder actuator 110 mounted by a cylinder mounting bracket 126 on the lower platform 13 and having a piston stem 110*a* coupled to the chassis of the transverse truck 108.

In a similar manner, the fore-and-aft truck 109 rides on wheels 117 on opposite lateral sides of its chassis, which wheels 117 roll along rails 115 fixedly laid on the inner sides of the lower flanges of channel-shaped, rail supporting members 125. These rail supporting members 125 are fixedly laid parallelly in spaced apart positions and in fore-and-aft direction on the chassis of the transverse truck 108. The fore-and-aft truck 109 is also provided with rollers 121 rolling along guide rails 119 fixed to the inner sides of the webs of the rail supporting members 125 and functioning to prevent side movement of the fore-and-aft truck 109. Upper rails 123 are also provided to prevent the wheels 117 from jumping upward and off the rails 115. The fore-and-aft truck 109 is driven in travel in the fore-and-aft direction by a fluid operated cylinder actuator 111 mounted by a cylinder mounting bracket 127 on the chassis of the transverse truck 108.

As in the preceding examples, the lower platform 13 is provided at its front part with a cutout recess 15 for the sidewise introduction of the lance 14 and for providing clearance sufficient for the gyratory motion of the lance in operation. The chassises of the transverse and fore-and-aft trucks 108 and 109 are similarly provided at their front parts with cutout recesses 15 for the same purpose.

In the operation of the device of the above described construction, the lance supporting centers of the transverse and fore-and-aft trucks 108 and 109 are first aligned coaxially with the converter 4 and thus set by controllably operating the cylinder actuators 110 and 111. Then, in the manner described hereinbefore, the lance 14 is placed into its operative position by means of hoisting means such as a crane and the lance holding device 10.

Then, after the lance 14 has been fitted through the node bearing 22 into the insertion opening 21 of the exhaust hood 5, and with the clamp jaws 56 of the lance holding device 10 in opened state, the piston stems 110*a* and 111*a* of the cylinder actuators 110 and 111 are caused to reciprocate with simple harmonic motion maintaining a mutual phase difference of 90 degrees and, moreover, having tuned amplitudes. As a consequence, the transverse truck 108 and the fore-and-aft truck 109 move in straight-line reciprocation relative to the lance carriage 6 and the transverse truck 108, respectively, and the fore-and-aft truck 109 revolves eccentrically with a radius of revolution equal to the amplitude component of the above mentioned simple harmonic motion. As a result of this eccentric revolution, the lance 14 is caused to undergo gyration with the node bearing 22 as a central node.

Figure 28:
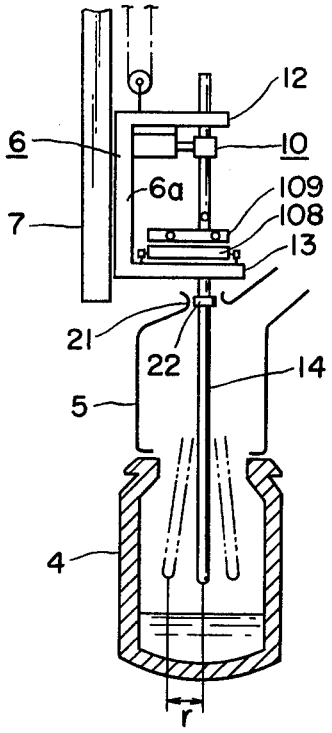
FIG. 28 is a schematic diagram similar to FIG. 1, but showing the general construction of a fifth example of the lance operating device according to this invention.
Figure 29:
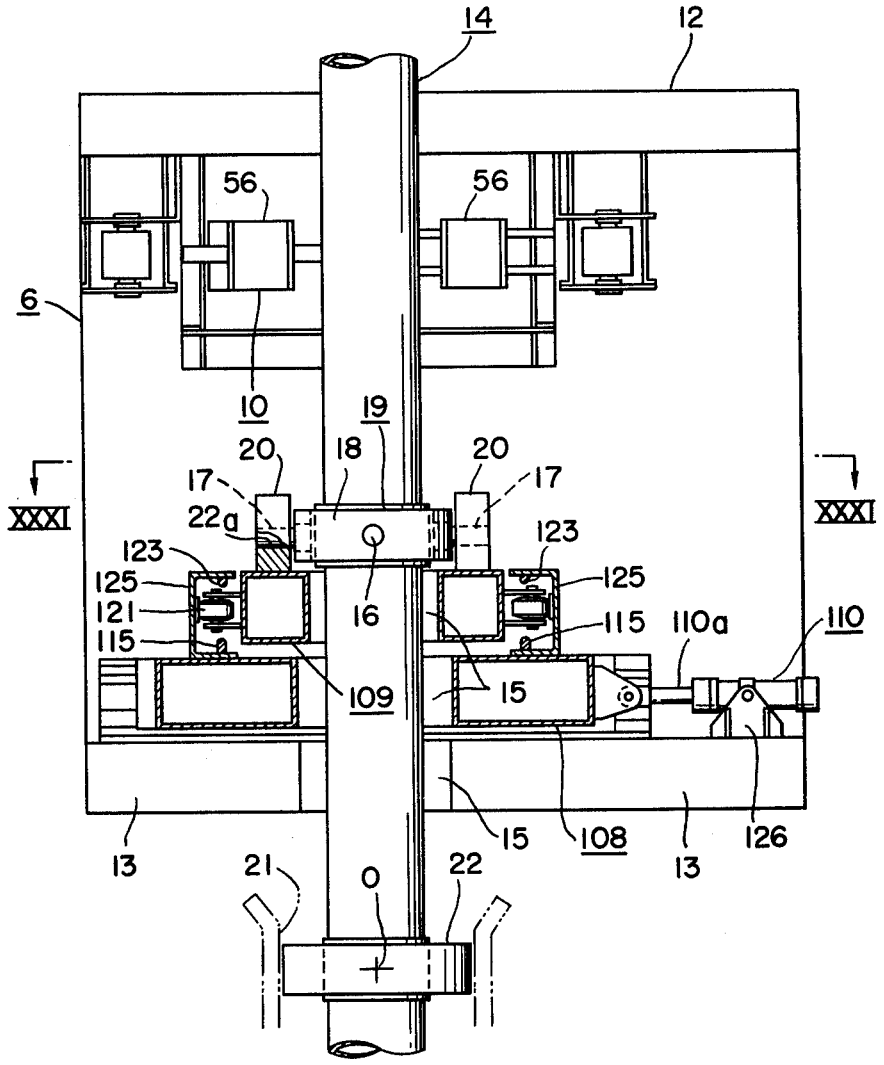
FIG. 29 is a front elevation of a lance carriage part of the fifth example of the lance operating device of the invention.
Figure 30:
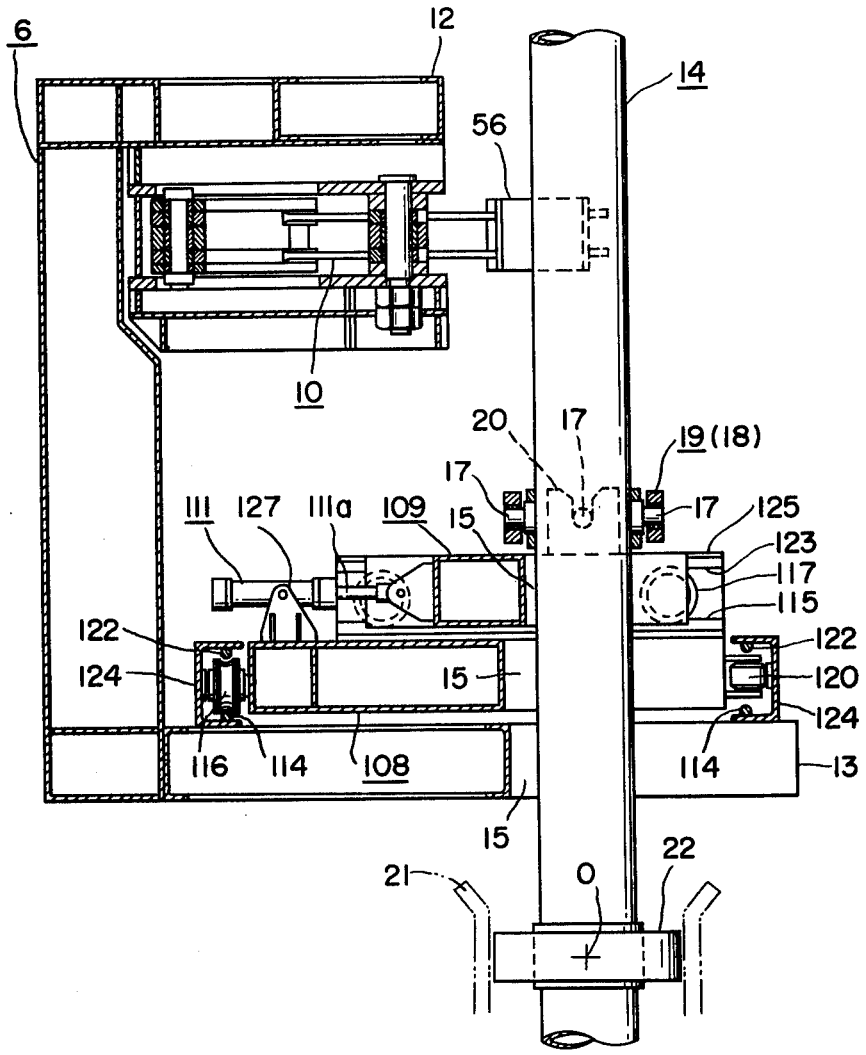
FIG. 30 is a side elevation, with parts shown in vertical section, of the lance carriage part shown in FIG. 29.
Figure 31:
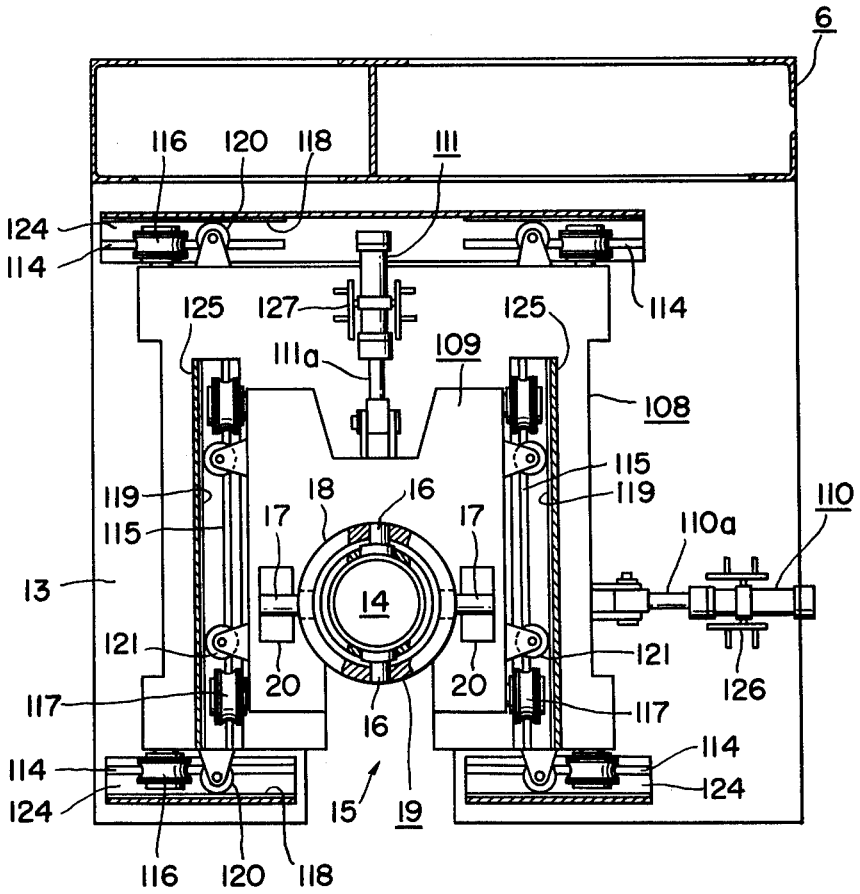
FIG. 31 is a plan view, partly in horizontal section, taken along the plane indicated by line XXXI—XXXI in FIG. 28.

It will be apparent from the above description that the radius *r* (as shown in FIG. 28) of revolution of the lower end of the lance 14 can be adjusted as desired by adjustably varying the operational strokes of the piston stems 110*a* and 111*a* of the cylinder actuators 110 and 111. Furthermore, by controlling the quantity of fluid supplied to the cylinder actuators 110 and 111, the speed of revolution of the lance 14 can be adjusted as desired.

In other respects, the construction and operation of this fifth example are the same or similar to those of the preceding examples.

We claim:

1. In a steel-refining converter having a lance disposed therein, a device for supporting and gyrating the lance, said device comprising:

a lance carriage disposed above the converter and supported and adapted to be movable in guided vertical movement;

wobble bearing means attached to a part of the lance to support the lance in a manner permitting the lance to undergo gyratory motion relative thereto;

a lance receiving structure for supporting the wobble bearing means, supporting to undergo a revolutionary motion in a horizontal plane about a specific vertical axis;

means for supporting the lance receiving structure on the lance carriage in a manner permitting said revolutionary motion;

means for adjusting the radius of revolution of said revolutionary motion;

means for driving the lance receiving structure in said revolutionary motion;

a lance holding means mounted on the lance carriage at a position vertically apart from the wobble bearing means in the lance supporting state thereof and operated to hold the lance in vertically fixed position coincident with said specific vertical axis; and node bearing means for the lance provided at a position such as to fit into a stationary structure disposed below and spaced apart from the wobble bearing means when the lance is in operative position in the converter and functioning to hold the lance against horizontal movement thereof thereby to constitute a central node about which the lance undergoes a gyratory motion when the lance receiving structure is thus driven in said revolutionary motion.

2. A device for supporting and gyrating the lance as claimed in claim 1, further including cutout recess means formed in pertinent parts of the device to permit the lance, in vertical position out of and above the converter, to be moved horizontally into position aligned with said specific vertical axis to be supported by the wobble bearing means.

3. A device for supporting and gyrating the lance as claimed in claim 1 in which said wobble bearing means is a gimbal mechanism having an inner ring fixed to a part of the lance, inner trunnions fixed to the inner ring, an outer gimbal ring rotatably supporting the inner trunnions, outer trunnions fixed to the outer gimbal ring, and journal bearings fixedly supported on the lance receiving structure and adapted to rotatably support the outer trunnions, said journal bearings having open upper parts permitting the outer trunnions to be installed thereinto from above.

4. A device for supporting and gyrating the lance as claimed in claim 1 in which said lance holding means comprises a pair of clamp jaws for clamping the lance, and actuating means for actuating the clamps jaws in clamping and unclamping action.

5. A device for supporting and gyrating the lance as claimed in claim 1 in which said means for supporting the lance receiving structure, said means for adjusting the radius of revolution, and said means for driving the lance receiving structure are included in a plurality of rotation devices mounted on the lance carriage and supporting the lance receiving structure at respective parts thereof, each rotation device comprising: a rotating base rotatably supported by the lance carriage to rotate about a vertical central axis; a motor mounted on the lance carriage to drive the rotating base in rotation; a vertical support shaft rotatably supported by the rotating base at an axial position offset from said central axis by an eccentricity distance and having an upper supporting part of crank form with a vertical axis offset from the axis of the support shaft by said distance, said supporting part being rotatably connected to and supporting a respective part of the lance receiving structure; and said means for adjusting the radius of revolution comprises a sun gear rotatably supported by the rotating base to rotate about a vertical axis coincident with said central axis, first and second, spaced apart planet gears fixed to a common vertical shaft and respectively meshed with the sun gear and a gear fixed to said support shaft, and first and second locking devices respectively for locking said common vertical shaft and a shaft to which the sun gear is fixed.

6. A device for supporting and gyrating the lance as claimed in claim 1 in which said means for supporting the lance receiving structure is a pair of rotating supports each comprising a bearing with a vertical axis mounted on the lance carriage, a rotating base rotatably supported by the bearing, a rotating pedestal having at its lower end a vertical eccentric shaft rotatably supported by the rotating base, and a vertical support shaft supported at its lower part by the rotating pedestal and having an axis offset by a distance from the axis of said vertical eccentric shaft of the rotating pedestal, said support shaft being fixed at its upper part to one part of the lance receiving structure.

7. A device for supporting and gyrating the lance as claimed in claim 6 in which said means for driving the lance receiving structure is a single rotation device comprising a rotating base rotatably supported by the lance carriage to rotate about a vertical central axis, a motor mounted on the lance carriage to drive the rotating base in rotation, a vertical support shaft rotatably supported by the rotating base at an axial position offset from said central axis by an eccentricity distance and having an upper supporting part of crank form with a vertical axis offset from the axis of the support shaft by said distance; said means for adjusting the radius of revolution comprises a sun gear rotatably supported by the rotating base to rotate about a vertical axis coincident with said central axis, first and second, spaced apart planet gears fixed to a common vertical shaft and respectively meshed with the sun gear and a gear fixed to said support shaft, and first and second locking devices respectively for locking said common vertical shaft and a shaft to which the sun gear is fixed; and driving power from the rotation device is transmitted to the lance receiving structure by a power transmission mechanism comprising a movement transmitting link pin connected at its middle part to said upper supporting part of the support shaft of the rotation device and a pair of expandable linkages of pantograph type fixedly anchored at their rear ends to the lance carriage and pin connected at their middle parts to respective ends of the movement transmitting link and at their front ends to respective support shafts of the rotating supports.

8. A device for supporting and gyrating the lance as claimed in claim 1 in which said means for supporting the lance receiving structure is made up of suspension devices each comprising a suspending rod, a universal joint by which the suspending rod is connected at its lower end to a respective one end of the lance receiving structure, and a pivotal means retaining the upper end of the suspending rod at the lance carriage.

9. A device for supporting and gyrating the lance as claimed in claim 8 in which said means for driving the lance receiving structure is a single rotation device comprising a rotating base rotatably supported by the lance carriage to rotate about a vertical central axis, a motor mounted on the lance carriage to drive the rotating base in rotation, a vertical support shaft rotatably supported by the rotating base at an axial position offset from said central axis by an eccentricity distance and having an upper supporting part of crank form with a vertical axis offset from the axis of the support shaft by said distance, and means for adjusting the radius of revolution comprises a sun gear rotatably supported by the rotating base to rotate about a vertical axis coincident with said central axis, first and second, spaced apart planet gears fixed to a common vertical shaft and respectively meshed with the sun gear amd a gear fixed to said support shaft, and first and second locking devices respectively for locking said common vertical shaft and a shaft to which the sun gear is fixed; and driving power from the rotation device is transmitted to the lance receiving structure by a power transmission mechanism comprising a movement transmitting link pin connected at its middle part to said upper supporting part of the support shaft of the rotation device and a pair of expandable linkages of pantograph type fixedly anchored at their rear ends to the lance carriage and pin connected at their middle parts to respective ends of the movement transmittting link and at their front ends to respective support shafts of the rotating supports.

10. A device for supporting and gyrating the lance as claimed in claim 1 in which said means for supporting the lance receiving structure, said means for adjusting the radius of revolution, and said means for driving the lance receiving structure are included in a plurality of rotation devices mounted on the lance carriage and supporting the lance receiving structure at respective parts thereof, each rotation device comprising: a vertical base shaft; a bearing for rotatably mounting the base shaft on the lance carriage; a connecting rod pin connected at its lower end by a pin to the upper end of the base shaft and thus being tiltable about the pin; a vertical support shaft pin connected at its lower end to the upper end of the connecting rod and rotatably connected by a bearing to a respective part of the lance receiving structure; an actuator fixedly mounted on the upper part of the base shaft and having an actuating member coupled to an intermediate part of the connecting rod and adjustably operated to tilt the connecting rod to a desired angle of tilt and thereby to offset the axis of the support shaft from the axis of the base shaft; and a driving mechanism driven by motor means for driving synchronously all base shafts in the same direction.

11. A device for supporting and gyrating the lance as claimed in claim 1 in which said means for supporting the lance receiving structure, said means for driving the same structure, and said means for adjusting the radius of revolution are included in a combination of a transverse truck movable in a direction on the lance carriage and a fore-and-aft truck movable in a direction transverse to said direction on the transverse truck, said lance receiving structure for supporting said first bearing device being mounted on the fore-and-aft truck, the transverse and fore-and-aft trucks being provided with respective driving devices for driving the trucks in said respective directions in adjustable reciprocating motions, which are controlled to produce a combined resultant motion which is said revolutionary motion, the radius of revolution being adjustable by adjustably varying the strokes of the reciprocating motions produced by the driving devices.

12. A device for supporting and gyrating the lance as claimed in claim 11, further including rail means for guiding said transverse and fore-and-aft trucks in said directions, respectively.

* * * * *